US011488768B2

(12) United States Patent
Lee et al.

(10) Patent No.: US 11,488,768 B2
(45) Date of Patent: Nov. 1, 2022

(54) COIL COMPONENT

(71) Applicant: Samsung Electro-Mechanics Co., Ltd., Suwon-si (KR)

(72) Inventors: Sa Yong Lee, Suwon-si (KR); Myung Sam Kang, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 24 days.

(21) Appl. No.: 16/408,746

(22) Filed: May 10, 2019

(65) Prior Publication Data

US 2019/0267182 A1 Aug. 29, 2019

Related U.S. Application Data

(63) Continuation of application No. 15/337,603, filed on Oct. 28, 2016, now abandoned.

(30) Foreign Application Priority Data

Nov. 20, 2015 (KR) ..... 10-2015-0163367

(51) Int. Cl.
*H01F 27/32* (2006.01)
*H01F 27/29* (2006.01)
(Continued)

(52) U.S. Cl.
CPC ..... *H01F 27/292* (2013.01); *H01F 17/0013* (2013.01); *H01F 17/04* (2013.01)

(58) Field of Classification Search
CPC .. H01F 17/04; H01F 17/0013; H01F 17/0006; H01F 2017/046; H01F 2017/002;
(Continued)

(56) References Cited

U.S. PATENT DOCUMENTS 5,583,424 A * 12/1996 Sato ..... G05F 1/575 323/282
6,031,445 A * 2/2000 Marty ..... H01F 27/2804 257/E21.022
(Continued)

FOREIGN PATENT DOCUMENTS

CN 102436902 A 5/2012
CN 103137286 A 6/2013
(Continued)

OTHER PUBLICATIONS

Korean Office Action dated Nov. 11, 2016, in counterpart Korean Application No. 10-2015-0163367 (9 pages in English, 8 pages in Korean).
(Continued)

*Primary Examiner* — Mang Tin Bik Lian
(74) *Attorney, Agent, or Firm* — NSIP Law

(57) ABSTRACT

A coil component includes: a body including a magnetic material, coil pattern layers disposed in the magnetic material, a core portion surrounded by the coil pattern layers, and an insulating layer disposed in the core portion and between adjacent coil pattern layers among the coil pattern layers, wherein each of the coil pattern layers comprises a spiral-shaped pattern; and an external electrode disposed on the body.

8 Claims, 17 Drawing Sheets

(51) Int. Cl.
*H01F 17/00* (2006.01)
*H01F 17/04* (2006.01)

(58) Field of Classification Search
CPC .... H01F 27/292; H01F 27/2804; H01F 27/29; H01F 27/323; H01F 2027/2809
USPC ..... 336/200, 192, 223
See application file for complete search history.

(56) References Cited

U.S. PATENT DOCUMENTS 6,054,914 A * 4/2000 Abel ..... H01F 1/344 336/200
6,515,568 B1 * 2/2003 Maki ..... H01F 3/10 336/200
6,996,892 B1 * 2/2006 Dening ..... H01F 17/0013 29/602.1
2002/0041223 A1 * 4/2002 Uriu ..... H01F 41/041 336/200
2004/0013793 A1 1/2004 Kamijima
2004/0164835 A1 8/2004 Shoji
2005/0195062 A1 9/2005 Yoshida et al.
2008/0012679 A1 * 1/2008 Okabe ..... H01F 41/046 336/200
2009/0051476 A1 * 2/2009 Tada ..... H01F 3/14 336/200
2010/0026443 A1 * 2/2010 Yan ..... H01F 27/29 336/234
2011/0050382 A1 * 3/2011 Baarman ..... H01F 27/255 336/221
2011/0074535 A1 3/2011 Banno
2012/0105188 A1 * 5/2012 Lim ..... H01F 27/245 336/200
2012/0286917 A1 * 11/2012 Uchida ..... H01F 41/042 336/200
2013/0214889 A1 * 8/2013 Kim ..... H01F 17/0033 336/192
2013/0222101 A1 8/2013 Ito et al.
2013/0222105 A1 * 8/2013 Sakai ..... H01F 5/003 336/200
2013/0234819 A1 * 9/2013 Yoo ..... H01F 17/0013 336/200
2013/0249662 A1 * 9/2013 Tonoyama ..... H01F 17/0013 336/200
2013/0249664 A1 9/2013 Tonoyama et al.
2014/0145812 A1 5/2014 Lee et al.
2014/0202741 A1 7/2014 Okamoto
2014/0285304 A1 9/2014 Yoo et al.
2015/0048918 A1 2/2015 Park et al.
2015/0155084 A1 * 6/2015 Kim ..... H05K 1/181 336/200

FOREIGN PATENT DOCUMENTS

CN 103180919 A 6/2013
CN 104078222 A 10/2014
JP H10-241983 A 9/1998
JP 2004-40001 A 2/2004
JP 2004-52046 A 2/2004
JP 2004-253684 A 9/2004
JP 2007-67214 A 3/2007
JP 2007067214 A * 3/2007
JP 2008-72071 A 3/2008
JP 2010-205905 A 9/2010
JP 2011-77157 A 4/2011
JP 2013-98554 A 5/2013
JP 2013-191863 A 9/2013
JP 2013-211526 A 10/2013
JP 2014-63981 A 4/2014
JP 2014-107548 A 6/2014
JP 2014-130969 A 7/2014
JP 2014-229739 A 12/2014
KR 2001-0001338 A 1/2001
KR 10-2014-0137306 A 12/2014
KR 10-2015-0019588 A 2/2015
KR 10-2015-0062836 A 6/2015
KR 10-2015-0080717 A 7/2015

OTHER PUBLICATIONS

Chinese Office Action dated Mar. 9, 2018, in corresponding Chinese Application No. 201611020285.0 (8 pages in English, 6 pages in Chinese).
Japanese Office Action dated Jul. 14, 2020 in counterpart Japanese Patent Application No. 2016-217974 ( 5 pages in English and 3 pages in Japanese).

* cited by examiner

COIL COMPONENT

CROSS-REFERENCE TO RELATED APPLICATIONS

This application is a continuation of U.S. application Ser. No. 15/337,603, filed on Oct. 28, 2016, which claims the benefit under 35 USC 119(a) of Korean Patent Application No. 10-2015-0163367 filed on Nov. 20, 2015 in the Korean Intellectual Property Office, the entire disclosures of which are incorporated herein by reference for all purposes.

BACKGROUND

1. Field

The following description relates to a coil component.

2. Description of Related Art

With miniaturization and thinning of electronic devices such as digital TVs, mobile phones, and laptop PCs, coil components used in these electronic devices are being required to be made smaller and thinner. To satisfy these purposes, the research and development of coil components having various forms of wirings or thin films are actively conducted.

One challenge in the miniaturization and thinning of coil components is to provide the same properties as conventional coil components regardless of such miniaturization and thinning. To satisfy these demands, a reduced size of cores filled with a magnetic material and low DC resistance ($R_{dc}$) may be required. To this end, there is an increased number of products to which technology such as anisotropic plating, that may increase the aspect ratio of a coil pattern and the cross section of a coil is applied.

When coil components are manufactured using anisotropic plating, an increase in the aspect ratio increases the risk of defects such as a deterioration in uniformity of plating growth and short circuits between coils. Furthermore, support members for use of the anisotropic plating may need to have a certain thickness to maintain their rigidity in order to enable a reduced thickness of a magnetic material covering a coil, thus providing a high permeability (Ls) while having reduced degrees of inductance.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a coil component includes: a body including a magnetic material, coil pattern layers encased by the magnetic material, a core portion surrounded by the coil pattern layers, and an insulating layer disposed in the core portion and between adjacent coil pattern layers among the coil pattern layers, wherein each of the coil pattern layers comprises a spiral-shaped pattern; and an external electrode disposed on the body.

The insulating layer may include a magnetic film.

The magnetic film may include an insulating resin and a magnetic filler.

The coil pattern layers may be connected by a via hole passing through the insulating layer.

The via hole may include an intermetallic compound (IMC).

The insulating may include insulating layers interposed between the coil pattern layers, and the coil pattern layers and the insulating layers may be alternately stacked.

Each of the coil pattern layers may be formed by a single plating layer.

Each of the coil pattern layers may have a thickness-to-width ratio less than or equal to 1 with respect to a width of the planar spiral-shaped pattern.

The coil pattern layers may be formed by plating layers.

Each of the coil pattern layers may have a thickness-to-width ratio greater than 1 with respect to a width of the planar spiral-shaped pattern.

The body may further include magnetic layers isolated by the insulating layer and contacting the coil pattern layers, respectively.

In another general aspect, a method of manufacturing a coil component includes: preparing at least one core board; forming a coil pattern layer including a planar spiral-shaped pattern on one or more surfaces of the at least one core board; forming a magnetic layer contacting the coil pattern layer on the one or more surfaces of the at least one core board; forming coil pattern layers contacting the magnetic layer by separating the coil pattern layer contacting the magnetic layer from the at least one core board; forming an insulating layer on at least one coil pattern layer contacting the magnetic layer among the coil pattern layers contacting the magnetic layer; forming a body by stacking the coil pattern layers contacting the magnetic layer such that the insulating layer is disposed in a core portion of the body and interposed between the coil pattern layers contacting the magnetic layer, and the coil pattern layers surround the core portion; and forming an external electrode on the body.

The forming of the insulating layer may include stacking a magnetic film including a magnetic material on the one or more surfaces of the at least one core board.

The method may further include: forming a via hole passing through the insulating layer; and filling the via hole with an inter-metallic compound (IMC), wherein when the coil pattern layers contacting the magnetic layer are stacked, the coil pattern layers contacting the magnetic layer are connected by the IMC filled in the via hole.

The insulating layer may include insulating layers interposed between the coil pattern layers, and the coil pattern layers and the insulating layers may be alternately stacked.

Each of the coil pattern layers may be formed using a one-time plating process.

The coil pattern layers may be formed using respective plating processes.

In another general aspect, a coil component includes: a body including a magnetic material, a coil encased by the magnetic material and including conductive pattern layers arranged in a stack and surrounding a central region of the body, and an insulating layer disposed in the central region and between adjacent conductive pattern layers among the conductive pattern layers; and an electrode disposed on an exterior surface of the magnetic body.

The coil component may further include vias connecting the conductive pattern layers to each other.

Each of the conductive pattern layers may include a plating layer without a seed layer.

Each of the conductive pattern layers may include a planar spiral-shaped pattern, and the planar spiral-shaped pattern may have a thickness-to-width ratio of 0.5 to 1.5.

In another general aspect, a method of manufacturing a coil component includes: forming a body by forming magnetic layers on respective conductive layers, and stacking an insulating layer and the conductive layers, having the magnetic layers disposed thereon, such that the conductive layers form a coil surrounding a core portion of the body and the insulating layer is disposed in the core portion and between adjacent conductive layers among the conductive layers; and forming an electrode on an outer surface of the body.

The method may further include connecting the conductive layers to each other using vias.

The method may further include forming the conductive layers by applying a plating material to seed layers and removing the seed layers.

Each of the conductive layers may include a planar spiral-shaped pattern, and the planar spiral-shaped pattern may have a thickness-to-width ratio of 0.5 to 1.5.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
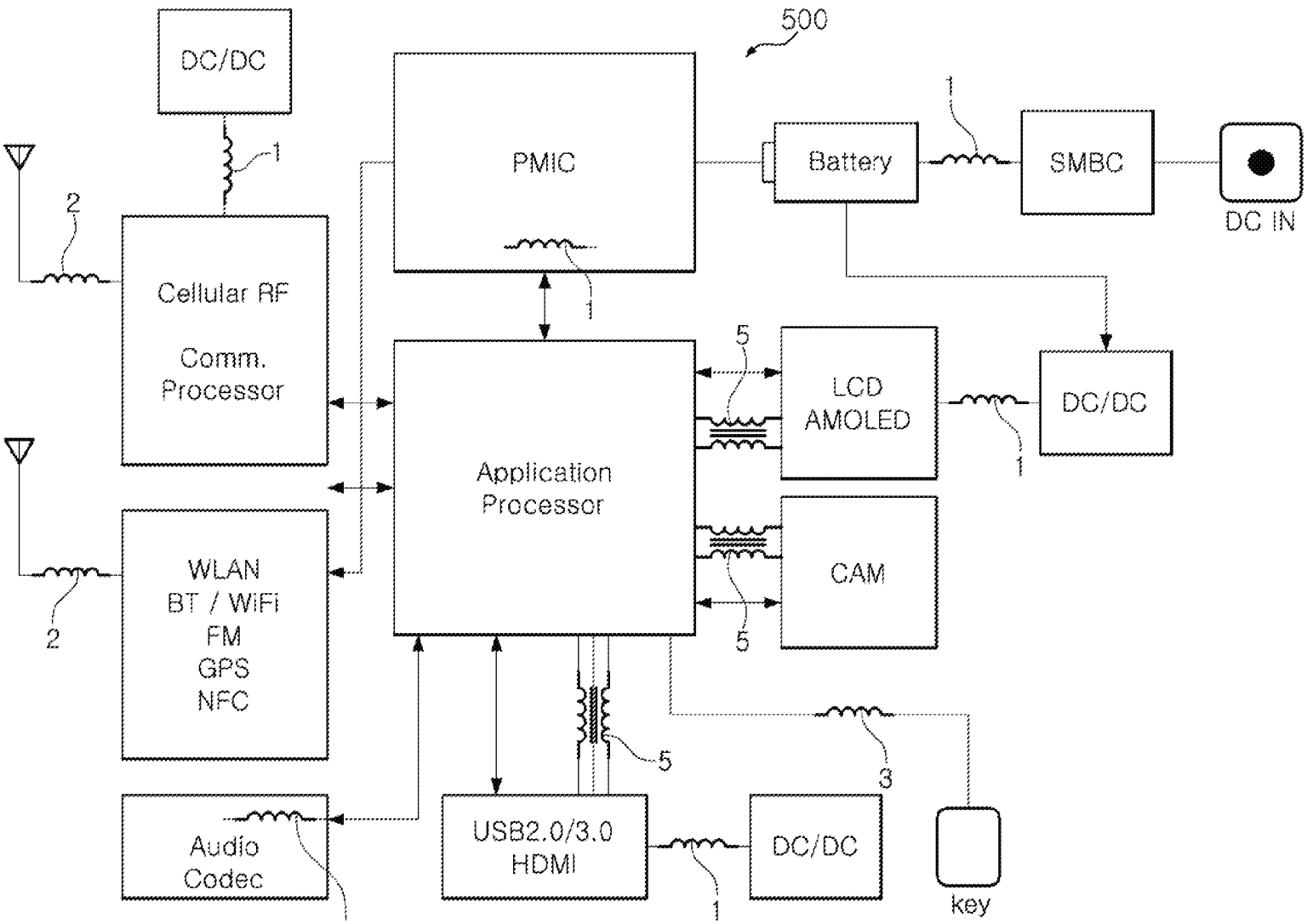
FIG. 1 is a schematic block diagram illustrating an example of coil components applied to electronic devices.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent. Further, although the examples described herein have a variety of configurations, other configurations are possible as will be apparent.

FIG. 1 is a schematic view illustrating an example of coil components applied to an electronic device 500. Referring to FIG. 1, it can be understood that various types of electronic components may be used in such an electronic device 500, such as a direct current/direct current (DC/DC) device, a Comm. Processor, a wireless local area network (WLAN) device, a Bluetooth (BT) device, a Wi-Fi device, a frequency modulation (FM) device, a global positioning system (GPS) device, a near field communication (NFC) device, a power management integrated circuit (PMIC), a battery, a switched-mode battery charger (SMBC), a liquid crystal display (LCD), an active-matrix organic light-emitting diode (AMOLED), audio codec, a universal serial bus (USB) 2.0/3.0 device, a high-definition multimedia interface (HDMI), or a camera or webcam (CAM), using an example application processor as a primary part, for example. In the illustrated example, various types of coil components, such as a power inductor 1, a high frequency (HF) inductor 2, a general bead 3, a high frequency (GHz) bead 4, or a common mode filter 5, may be properly disposed in spaces between these electronic components to remove noise or the like according to intended uses or operations of the electronic components.

The power inductor 1 may store electricity in the form of a magnetic field to maintain an output voltage, thereby stabilizing power supply. The HF inductor 2 may match impedance to obtain a required frequency, or block a noise or an alternating current (AC) component. The general bead 3 may remove noise of power and signal lines, or may eliminate a high frequency ripple. The high frequency (GHz) bead 4 may remove high frequency noise of power and signal lines related to audio. The common mode filter 5 may pass electricity in a differential mode, and may remove only common mode noise.

The electronic device embodiment may be a smartphone, but is not limited thereto. For example, the electronic device may be a personal digital assistant, a digital video camera, a digital still camera, a network system, a computer, a monitor, a television, a video game console, or a smart watch. The electronic device may also be various other types of electronic devices.

A coil component, according to an embodiment, is described in more detail in the following disclosure. The coil component is described herein as having a structure of an inductor for the sake of convenience, however, the coil component may be applied to coil components having various different purposes, as described above. Additionally, a lateral portion referenced below may define a first direction or a second direction, an upper portion referenced below may define a third direction, and a lower portion referenced below may define a direction opposite the third direction, for convenience. Further, locating a component on the lateral portion, the upper portion, or the lower portion may include providing direct contact or indirect contact between the component and a reference component in a direction. Although the disclosure may define a particular direction for convenience of description, the scope of the disclosure is not limited to descriptions of the particular direction.

Figure 2:
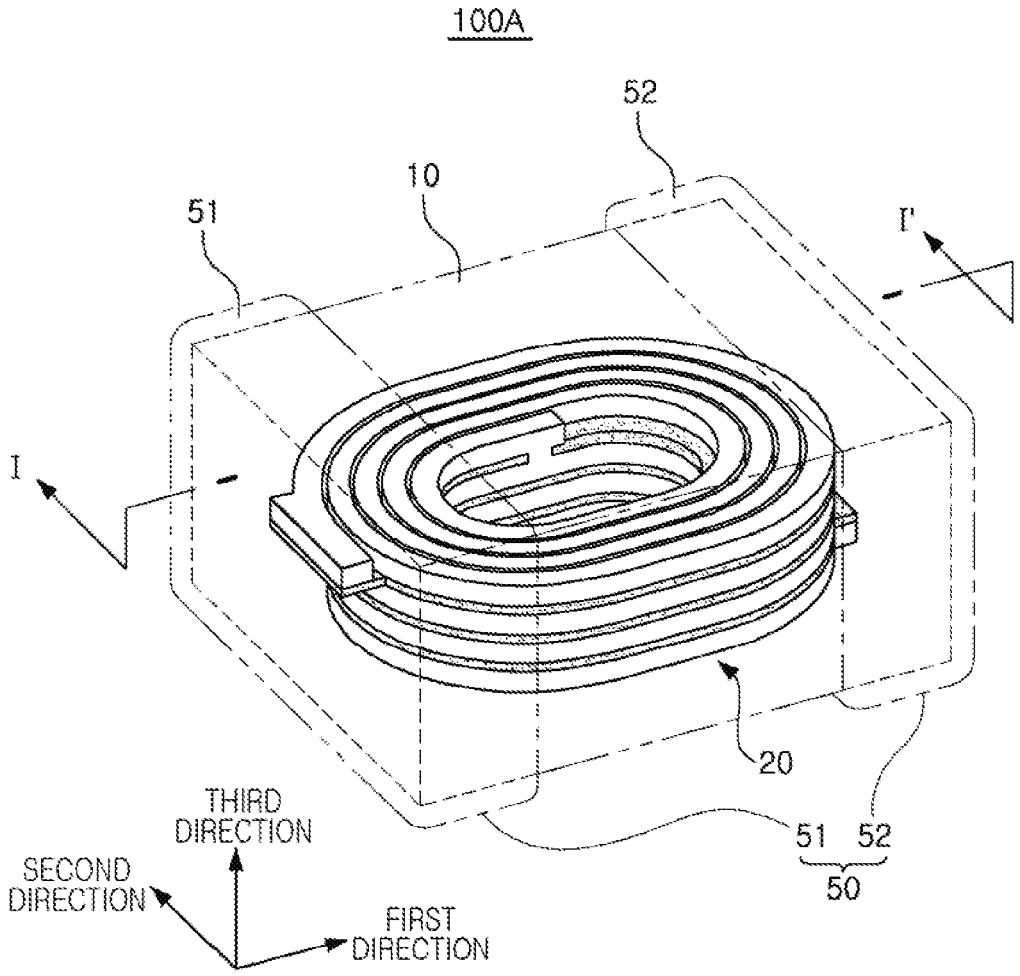
FIG. 2 is a schematic perspective view illustrating an example of a coil component.

FIG. 2 is a schematic perspective view illustrating an example of a coil component 100A. Referring to FIG. 2, the coil component 100A includes a body 10 and an electrode 50 disposed on the body 10. A coil 20 is disposed inside the body 10. The coil 20 may be embedded in a magnetic material. The electrode 50 includes a first electrode 51 and a second electrode 52 spaced apart from each other on the body 10. The first electrode 51 and the second electrode 52 are connected to different terminals of the coil 20, respectively. An arrangement of the electrode 50 may be changed according to types of coil components used in different applications.

The body 10 may form the general exterior appearance or shape of the coil component 100A, and may include a first surface and a second surface opposing each other in a first direction, a third surface and a fourth surface opposing each other in a second direction, and a fifth surface and a sixth surface opposing each other in a third direction. The first, second and third directions may be orthogonal to one another. The body 10 may be hexahedral, but is not limited to such a shape. The body 10 may include a magnetic material, and may have the coil 20 disposed in the magnetic material. The configuration of the coil 20 in the magnetic material of the body 10 will be described below.

The electrode 50 may electrically connect the coil component 100A to an electronic device when the coil component 100A is mounted in the electronic device. The electrode 50 includes a first electrode 51 and a second electrode 52 spaced apart from each other on the body 10. The electrode 50 may include, for example, a conductive resin layer and a conductive layer formed on the conductive resin layer. The conductive resin layer may include a thermosetting resin and a conductive metal including at least one of copper (Cu), nickel (Ni), or silver (Ag. The conductive layer may include at least one of nickel (Ni), copper (Cu), or tin (Sn), and, for example, a nickel (Ni) layer and a tin (Sn) layer may be sequentially formed in the conductive layer.

Figure 3:
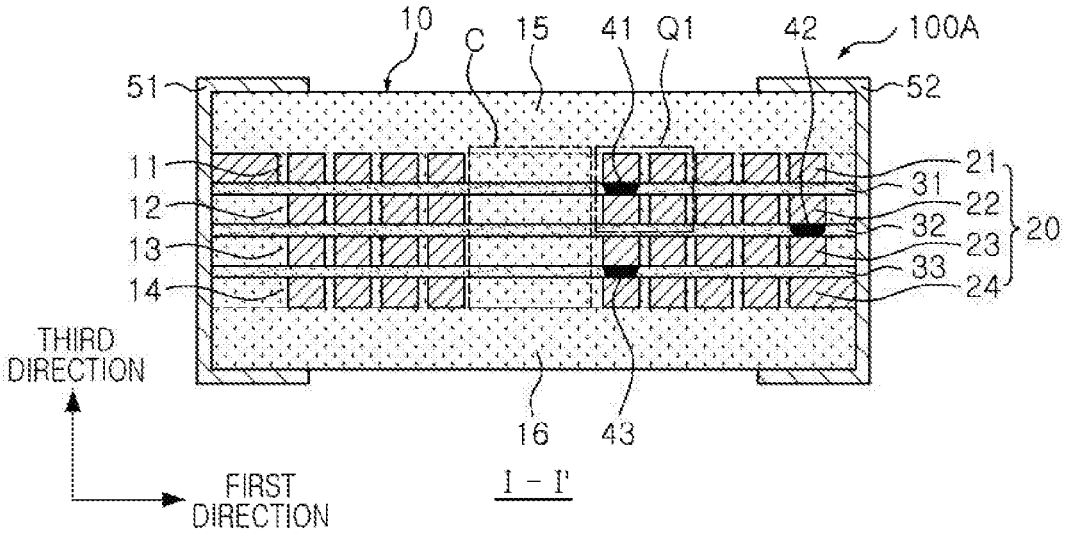
FIG. 3 is a schematic cutaway cross-sectional view taken along line I-I' of the coil component illustrated in FIG. 2.
Figure 4:
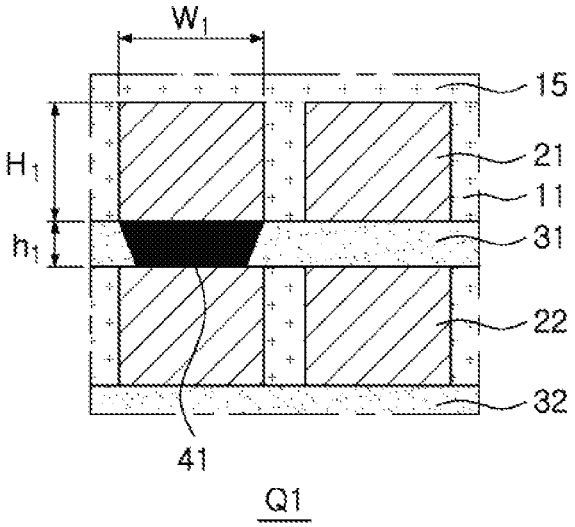
FIG. 4 is a schematic enlarged cross-sectional view of region Q1 of the coil component illustrated in FIG. 3.

FIG. 3 is a schematic cutaway cross-sectional view of the coil component 100A taken along line I-I' of FIG. 2. FIG. 4 is a schematic enlarged cross-sectional view of region Q1 of the coil component 100A illustrated in FIG. 3. Referring to FIGS. 3 and 4, the body 10 may include first to fourth conductive layers 21, 22, 23, and 24, first to third insulating layers 31, 32, and 33 respectively disposed in spaces between the first and second conductive layers 21 and 22, the second and third conductive layers 22 and 23, and the third and fourth conductive layers 23 and 24, and respectively having first to third vias 41, 42, and 43 connecting the first to fourth conductive layers 21, 22, 23, and 24 to each other, and first to sixth magnetic layers 11, 12, 13, 14, 15, and 16 surrounding the first to fourth conductive layers 21, 22, 23, and 24. The first to fourth conductive layers 21, 22, 23, and 24 may be connected to each other to form a single coil 20 having an increased number of turns in a horizontal direction and a vertical direction.

As illustrated in FIG. 3, the first to fourth conductive layers 21, 22, 23, and 24 surround a core portion C of the body 10. The core portion C may be disposed at a central area of the body 10. The first to third insulating layers 31, 32, and 33, and the first to fourth magnetic layers 11, 12, 13, and 14 extend through the core portion C. However, in the example illustrated in FIG. 3, the first to fourth conductive layers 21, 22, 23, and 24 do not extend into the core portion C. Although the core portion C is illustrated as being a specific area within dotted lines, the core portion C can have any size, shape, position or orientation corresponding to an area of a body of a coil component that is surrounded but not occupied by conductive layers of a coil.

The coil component 100A may perform various functions in the electronic device through properties exhibited by the coil 20. For example, the coil component 100A may be a power inductor. In this case, a coil may store electricity in a magnetic field form to maintain output voltage, stabilizing power supply. As described above, the first to fourth conductive layers 21, 22, 23, and 24 disposed in different layers may be electrically connected to each other through the first to third vias 41, 42, and 43, formed in the first to third insulating layers 31, 32, and 33 disposed between the first to fourth conductive layers 21, 22, 23, and 24, to form the coil 20.

The first to fourth conductive layers 21, 22, 23, and 24 may each have planar spiral-shaped patterns. The planar spiral-shaped pattern of each of the first to fourth conductive layers 21, 22, 23, and 24 may have a number of turns that is greater than or equal to two. For example, the coil 20 may an increased number of turns in the horizontal direction and the vertical direction, which is beneficial to achieving a high degree of inductance. The planar spiral-shaped pattern of each of the first to fourth conductive layers 21, 22, 23, and 24 may have an aspect ratio (AR) of 0.5 to 1.5, the AR being a ratio of a thickness $H_1$ to a width $W_1$. Thus, the risk of a defect such as a short circuit or the like may be reduced, and uniformity of a coil and low DC resistance ($R_{dc}$) thereof may be achieved. Each of the first to fourth conductive layers 21, 22, 23, and 24 may include a single conductive layer. Thus, the first to fourth conductive layers 21, 22, 23, and 24 may be readily formed. The first to fourth conductive layers 21, 22, 23, and 24 may have no separate seed layer and may be formed on each other. For example, as can be seen from the following process descriptions, a metal layer functioning as a seed layer may be removed after forming of the first to fourth conductive layers 21, 22, 23, and 24. Thus, an upper or lower surface of each of the first to fourth conductive layers 21, 22, 23, and 24 may contact at least one of the first to third insulating layers 31, 32, and 33. The first to fourth conductive layers 21, 22, 23, and 24 may be formed using a conductive material such as copper (Cu), aluminum (Al), silver (Ag), tin (Sn), gold (Au), nickel (Ni), or lead (Pb) that is a common plating material, or alloys thereof.

The first to third insulating layers 31, 32, and 33 may selectively insulate the first to fourth conductive layers 21, 22, 23, and 24 from each other. Any material including an insulating material may be used as a material of each of the first to third insulating layers 31, 32, and 33. For example, a well-known photoimageable dielectric (PID) resin or the like may be used. The first to third insulating layers 31, 32, and 33 may also include an insulating resin and a magnetic filler. In such an example, the electrical resistance of an interlayer magnetic field may be removed or avoided. A thickness $h_1$ of each of the first to third insulating layers 31, 32, and 33 may be reduced, and for example, may be less than the thickness $H_1$ of the planar spiral-shaped pattern of each of the first to fourth conductive layers 21, 22, 23, and 24. Such a configuration may allow a thickness of a magnetic material covering the coil 20 to be significantly increased, resulting in an increase in inductance. Further, first to third vias 41, 42, and 43 formed in the first to third insulating layers 31, 32, and 33, respectively, may be formed to have a microstructure, so that the coil 20 may have a constant thickness.

For example, the insulating resin may be an epoxy resin. The epoxy resin may be, for example, a bisphenol A-type epoxy resin, a bisphenol F-type epoxy resin, a bisphenol S-type epoxy resin, a bisphenol AF-type epoxy resin, a dicyclopentadiene-type epoxy resin, a trisphenol epoxy resin, a naphthol novolak epoxy resin, a phenol novolak-type epoxy resin, a tert-butyl-catechol-type epoxy resin, a naphthalene-type epoxy resins, a naphthol-type epoxy resin, an anthracene-type epoxy resin, a glycidyl amine-type epoxy resin, a glycidyl ester-type epoxy resin, a cresol novolak-type epoxy resin, a biphenyl-type epoxy resin, a linear aliphatic epoxy resin, an epoxy resin having a butadiene structure, an alicyclic epoxy resin, a heterocyclic epoxy resin, a spiro ring-containing epoxy resin, a cyclohexanedimethanol-type epoxy resin, a naphthylene ether-type epoxy resin, or a trimethylol-type epoxy resin. One kind or multiple kinds of epoxy resins may be used.

A material of the magnetic filler is not particularly limited, and for example, may include Fe alloys such as a pure iron powder, an Fe—Si-based alloy powder, an Fe—Si—Al-based alloy powder, an Fe—Ni-based alloy powder, an Fe—Ni—Mo-based alloy powder, an Fe—Ni—Mo—Cu-based alloy powder, an Fe—Co-based alloy powder, an Fe—Ni—Co-based alloy powder, an Fe—Cr-based alloy powder, an Fe—Cr—Si-based alloy powder, an Fe—Ni—Cr-based alloy powder, or an Fe—Cr—Al-based Fe alloy, amorphous alloys such as an Fe-based amorphous alloy and a Co-based amorphous alloy, spinel-type ferrites such as a Mg—Zn-based ferrite, a Mn—Mg-based ferrite, a Cu—Zn-based ferrite, a Mg—Mn—Sr-based ferrite, and a Ni—Zn-based ferrite, hexagonal ferrites such as a Ba—Zn-based ferrite, a Ba—Mg-based ferrite, a Ba—Ni-based ferrite, a Ba—Co-based ferrite, a Ba—Ni—Co-based ferrite, or garnet-type ferrites such as a Y-based ferrite and the like.

As long as the first to third vias 41, 42, and 43 may electrically connect the first to fourth conductive layers 21, 22, 23, and 24 to each other, a shape of each of first to third vias 41, 42, and 43 is not particularly limited. For example, the shape of each of the first to third vias 41, 42, and 43 may include any shape known in the technical field of this disclosure, including a tapered shape in which a diameter of each of the first to third vias 41, 42, and 43 is decreased toward a lower surface of the via, a reverse tapered shape in which the diameter is increased toward the lower surface of the via, or a cylindrical; shape. A material of each of the first to third vias 41, 42, and 43 may include an inter-metallic compound (IMC). When the vias 41, 42 and 43 include an IMC, connectivity between the first to fourth conductive layers 21, 22, 23, and 24 may be increased. As an example, the IMC may be formed by printing a well-known metal paste in the vias 41, 42, and 43. For example, the IMC may include copper (Cu)-tin (Sn), silver (Ag)/tin (Sn), copper (Cu)/tin (Sn) coated with silver (Ag), or copper (Cu)/tin (Sn)-bismuth (Bi), but is not limited to such materials. The IMC may be formed of a known metallic coating, and, for example, may include tin (Sn) or copper (Cu)-tin (Sn).

The first to sixth magnetic layers 11, 12, 13, 14, 15, and 16 may improve magnetic properties of the coil 20. The first to fourth magnetic layers 11, 12, 13, and 14 may be coplanar with the first to fourth conductive layers 21, 22, 23, and 24, respectively. The first to fourth magnetic layers 11, 12, 13, and 14 and the first to fourth conductive layers 21, 22, 23, and 24, respectively, may be spaced apart from each other by the first to third insulating layers 31, 32, and 33. The first to fourth magnetic layers 11, 12, 13, and 14 may surround the first to fourth conductive layers 21, 22, 23, and 24, respectively, and lateral surfaces of the first to fourth conductive layers 21, 22, 23, and 24 may contact the first to fourth magnetic layers 11, 12, 13, and 14, respectively. The fifth and sixth magnetic layers 15 and 16 may respectively cover an upper portion and a lower portion of the coil 20. The coil component 100A may include the first to third insulating layers 31, 32, and 33 each having a reduced thickness as described above to thereby achieve a satisfactory thickness of each of the fifth and sixth magnetic layers 15 and 16, and resulting in being beneficial to achieving a high degree of inductance. Any material including a magnetic material may be used as a material of each of the first to sixth magnetic layers 11, 12, 13, 14, 15, and 16. For example, the material of the first to sixth magnetic layers 11, 12, 13, 14, 15, and 16 may include a ferrite or a resin filled with metallic magnetic particles. Also, similar to the first to third insulating layers 31, 32, and 33, each of the first to sixth magnetic layers 11, 12, 13, 14, 15, and 16 may include an insulating resin and a magnetic filler. For example, the first to sixth magnetic layers 11, 12, 13, 14, 15, and 16 and the first to third insulating layers 31, 32, and 33 may include the same material, according to circumstances. When the first to sixth magnetic layers 11, 12, 13, 14, 15, and 16 first to third insulating layers 31, 32, and 33 include the same material, boundaries between the first to third insulating layers 31, 32, and 33 and the first to sixth magnetic layers 11, 12, 13, 14, 15, and 16 may be unclear. For example, the first to third insulating layers 31, 32, and 33 and the first to sixth magnetic layers 11, 12, 13, 14, 15, and 16 may be integrated with each other. Such a configuration will be described below. Examples of the insulating resin and the magnetic filler may be the same as those described above.

The drawings illustrate only the first to fourth conductive layers 21, 22, 23, and 24, the first to third insulating layers 31, 32, and 33, the first to third vias 41, 42, and 43, and the first to sixth magnetic layers 11, 12, 13, 14, 15, and 16, but may include additional layers or fewer layers. The descriptions provided above may apply to an additional layer in an identical manner, and a detailed description of such an additional layer will be omitted.

Figure 5:
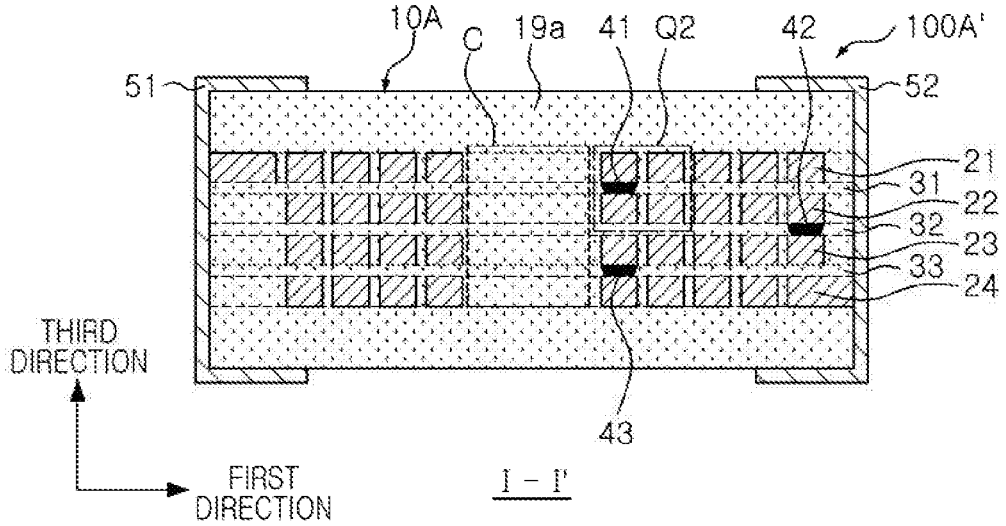
FIG. 5 is another schematic cutaway cross-sectional view taken along line I-I' of the coil component illustrated in FIG. 2.
Figure 6:
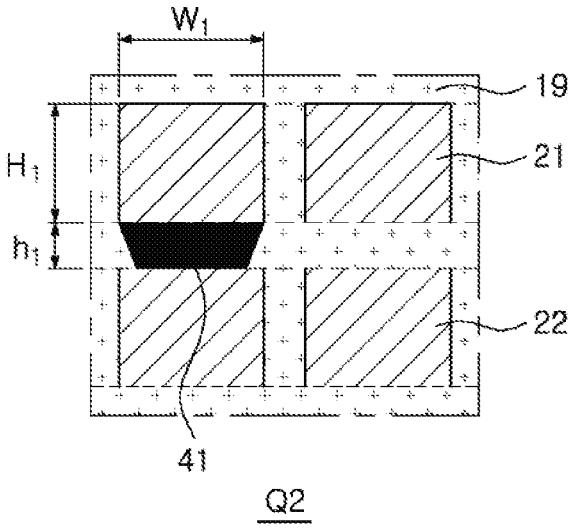
FIG. 6 is a schematic enlarged cross-sectional view of region Q2 of the coil component illustrated in FIG. 5.

FIG. 5 is another schematic cutaway cross-sectional view taken along line I-I' of FIG. 2, illustrating a coil component 100A' according to another embodiment. FIG. 6 is a schematic enlarged cross-sectional view of region Q2 of the coil component 100A' illustrated in FIG. 5. Referring to FIGS. 5 and 6, the body 10A of the coil component 100A' may include the first to fourth conductive layers 21, 22, 23, and 24 and a first electrically insulating magnetic layer 19*a* embedding therein the first to fourth conductive layers 21, 22, 23, and 24. The first electrically insulating magnetic layer 19*a* may include the first to third vias 41, 42, and 43 disposed in spaces between the first and second conductive layers 21 and 22, the second and third conductive layers 22 and 23, and the third and fourth conductive layers 23 and 24, respectively, to connect the first to fourth conductive layers 21, 22, 23, and 24 to each other. Similarly, the first to fourth conductive layers 21, 22, 23, and 24 may be connected to each other to form a single coil 20 having the number of turns increased in the horizontal direction and the vertical direction. A description overlapping the foregoing description may hereinafter be omitted, and the first electrically insulating magnetic layer 19*a* will be described in more detail below.

The first electrically insulating magnetic layer 19*a* may be formed by integrating the first to third insulating layers 31, 32, and 33 with the first to sixth magnetic layers 11, 12, 13, 14, 15, and 16. In other words, as described above, the first to third insulating layers 31, 32, and 33 and the first to sixth magnetic layers 11, 12, 13, 14, 15, and 16 may include the same material, and for example, may include the same insulating resin and the same magnetic filler. In this case, the first to third insulating layers 31, 32, and 33 and the first to sixth magnetic layers 11, 12, 13, 14, 15, and 16 may be integrated with each other in such a manner that boundaries therebetween may be unclear, depending on formation methods. As a result, a first single electrically insulating magnetic layer 19*a* may be formed. The first electrically insulating magnetic layer 19*a* may selectively insulate the first to fourth conductive layers 21, 22, 23, and 24 from each other, and may improve magnetic properties. Examples of the insulating resin and the magnetic filler may be the same as those described above.

As illustrated in FIG. 5, the first to fourth conductive layers 21, 22, 23, and 24 surround the core portion C of the body 10A. The first electrically insulating magnetic layer 19*a* extends through the core portion C. However, in the example illustrated in FIG. 5, the first to fourth conductive layers 21, 22, 23, and 24 do not extend into the core portion C.

FIGS. 7 through 11 are schematic views illustrating an example of a method of manufacturing a coil component, such as the coil component 100A illustrated in FIGS. 2-4, and/or the coil component 100A' illustrated in FIGS. 5-6, though embodiments are not limited thereto. Thus, though a description of one or more processes herein may be explained by reference to features with similar reference numbers as those of FIGS. 2-6, this is for convenience of explanation, and embodiments are not limited thereto. Referring to FIGS. 7 through 11, a method of manufacturing the coil component 100A, according to an embodiment, includes: preparing two core boards 200 each including a support member 201, first metal layers 202 disposed on opposing surfaces of the support member 201, and second metal layers 203 respectively disposed on the first metal layers 202; forming the first and fourth conductive layers 21 and 24, each having a planar spiral-shaped pattern, on the respective second metal layers 203 of one of the two core boards 200, and forming the second and third conductive layers 22 and 23, each having the planar spiral-shaped pattern, on the second metal layers 203 of the other of the two core boards 200; forming the first to fourth magnetic layers 11, 12, 13, and 14 respectively surrounding the first to fourth conductive layers 21, 22, 23, and 24; separating the first to fourth conductive layers 21, 22, 23, and 24 respectively surrounded by the first to fourth magnetic layers 11, 12, 13, and 14 from the support members 201; layering the first to third insulating layers 31, 32, and 33 on the second to fourth conductive layers 22, 23, and 24, respectively, of the first to fourth conductive layers 21, 22, 23, and 24 respectively surrounded by the first to fourth magnetic layers 11, 12, 13, and 14; forming the first to third vias 41, 42, and 43 in the first to third insulating layers 31, 32, and 33, respectively; removing the second metal layers 203 remaining on the first to fourth conductive layers 21, 22, 23, and 24 respectively surrounded by the first to fourth magnetic layers 11, 12, 13, and 14; forming the body 10 by layering the second to fourth conductive layers 22, 23, and 24 respectively surrounded by the second to fourth magnetic layers 12, 13, and 14, the first conductive layer 21 surrounded by the first magnetic layer 11, and the fifth and sixth magnetic layers 15 and 16, the second to fourth conductive layers 22, 23, and 24 having the first to third insulating layers 31, 32, and 33 formed through a series of processes and respectively layered thereon; and forming the electrode 50 on the body 10. A description overlapping the abovementioned description may hereinafter be omitted, and each of the aforementioned processes will be described in more detail below.

Figure 7:
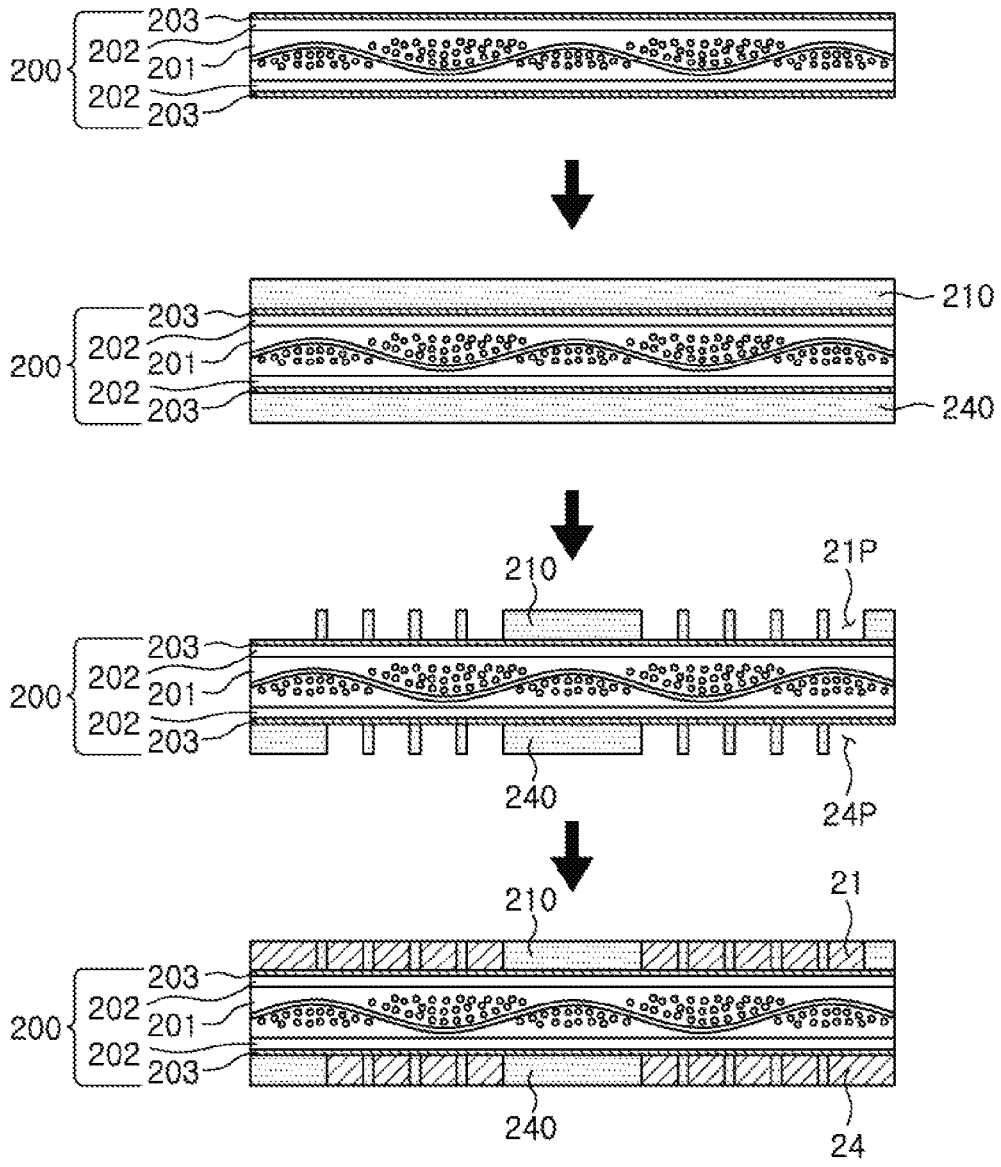
FIGS. 7 through 11 are schematic views illustrating an example of a method of manufacturing a coil component.

Referring to FIG. 7, a first one of the two core boards 200 may be prepared. The first core board 200 may include the support member 201, the first metal layers 202 respectively disposed on the opposing surfaces of the support member 201, and the second metal layers 203 respectively disposed on the first metal layers 202. In an embodiment, the first metal layer 202 and the second metal layer 203 may be disposed on only one surface of the support member 201. In other embodiments, only the second metal layer 203 may be disposed one surface or opposing surfaces of the support member 201.

For example, the support member 201 may be an insulating board including an insulating resin. The insulating resin may include a thermosetting resin such as an epoxy resin, a thermoplastic resin such as a polyimid, or a resin in which a stiffener such as a glass fiber or an inorganic filler is impregnated such as a pre-preg, an Ajinomoto build-up film (ABF), a FR-4 resin, a bismaleimide triazine (BT) resin, or a photoimageable dielectric (PID) resin, but is not limited to such materials. The first metal layer 202 and the second metal layer 203 may both be a thin copper foil, but are not limited to such a material. Alternatively, the first metal layer 202 and the second metal layer 203 may be formed from different metal materials. For example, the core board 200 may be a copper clad laminate (CCL) well known in the technical field of this disclosure, but is not limited such a construction.

Subsequently, the first and fourth conductive layers 21 and 24 may be respectively formed on the second metal layers 203 of the first core board 200. The first and fourth conductive layers 21 and 24 may be formed by forming a first dry film 210 and a fourth dry film 240 on the second metal layers 203, respectively, creating planar spiral-shaped patterns or channels 21P and 24P in the first and fourth dry films 210 and 240, respectively, using a well-known photolithography method, and filling the planar spiral-shaped patterns 21P and 24P using a well-known plating method. The plating method may, for example, use electrolytic copper plating or electroless copper plating. In more detail, the plating method may include a method such as chemical vapor deposition (CVD), physical vapor deposition (PVD), sputtering, a subtractive process, an additive process, a semi-additive process (SAP), or a modified semi-additive process (MSAP), but is not limited to such examples.

Figure 8:
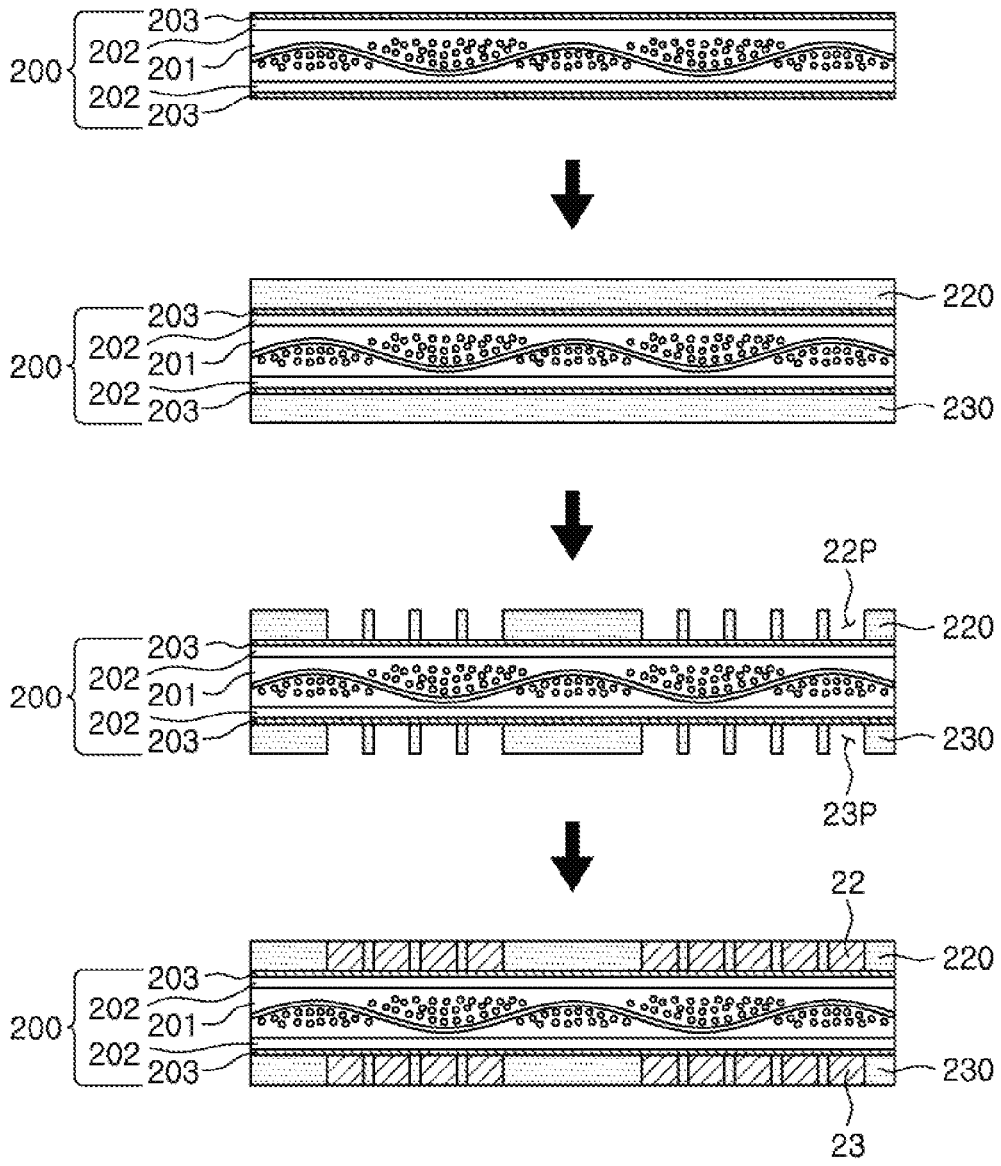

Referring to FIG. 8, a second core board 200 may be prepared. The second core board 200 may include the support member 201, the first metal layers 202 respectively disposed on the opposing surfaces of the support member 201, and the second metal layers 203 respectively disposed on the first metal layers 202. In an embodiment, the first metal layer 202 and the second metal layer 203 may be disposed on only one surface of the support member 201. In other embodiments, only the second metal layer 203 may be disposed on one surface or opposing surfaces of the support member 201.

Subsequently, the second and third conductive layers 22 and 23 may be respectively formed on the second metal layers 203 of the second core board 200. The second and third conductive layers 22 and 23 may be formed by forming a second dry film 220 and a third dry film 230 on the second metal layers 203, respectively, creating planar spiral-shaped patterns or channels 22P and 23P in the second and third dry films 220 and 230 using the well-known photolithography method, and filling the planar spiral-shaped patterns 22P and 23P using the well-known plating method, as described above with respect to the first core board 200.

Figure 9:
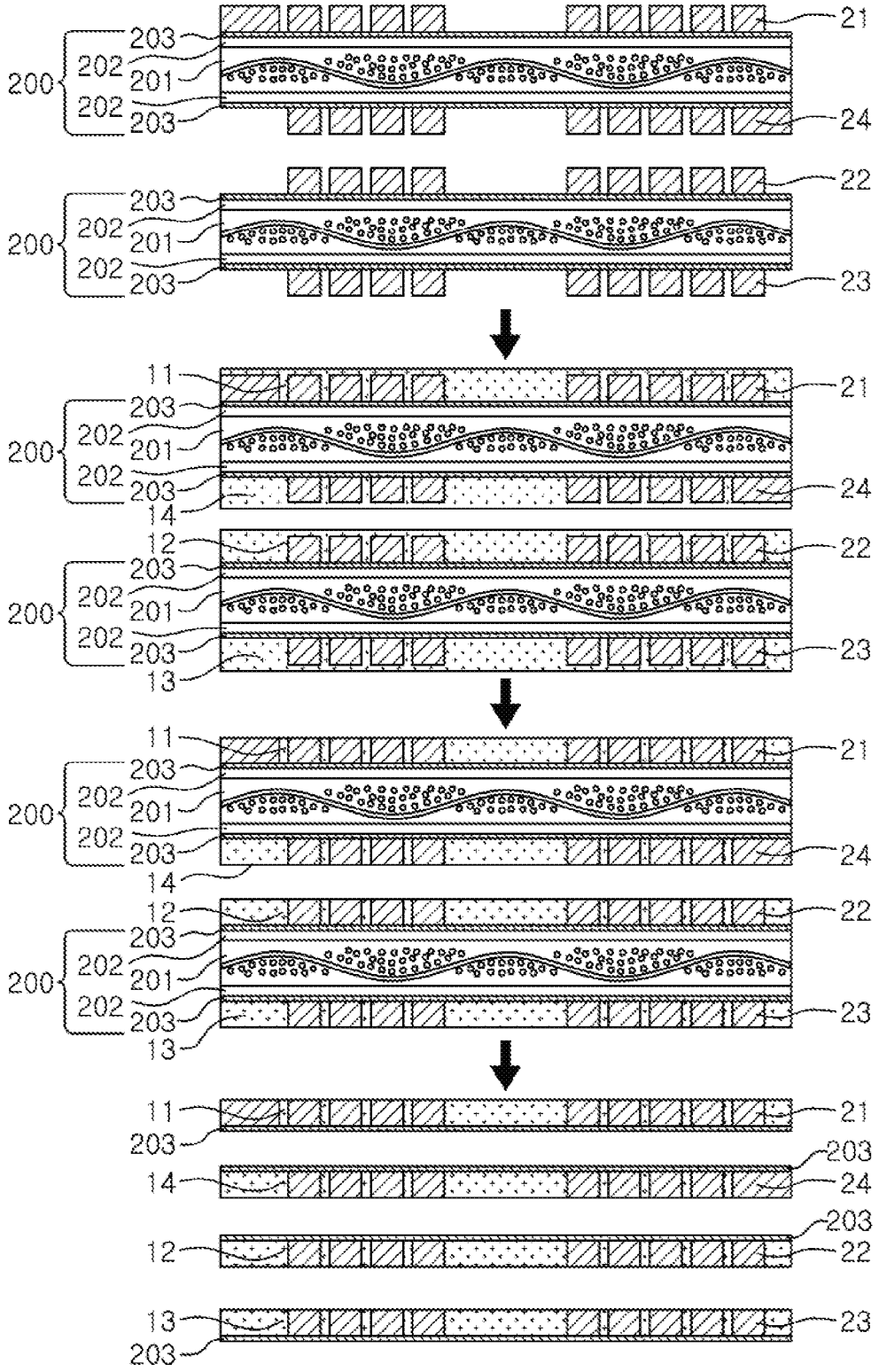

Referring to FIG. 9, the first to fourth dry films 210, 220, 230, and 240 may be stripped away from the respective core boards 200. More specifically, the first to fourth dry films 210, 220, 230, and 240 may be stripped away from the respective second metal layers and first to fourth conductive layers 21, 22, 23, and 24. A well-known etching method may be applied to perform the stripping, but the stripping is not limited to such a method. Subsequently, the first to fourth magnetic layers 11, 12, 13, and 14 may be formed to surround the first to fourth conductive layers 21, 22, 23, and 24. The first to fourth magnetic layers 11, 12, 13, and 14 may be formed, for example, using a well-known layering or coating method. When such a layering or coating method is used, protrusions of the first to fourth magnetic layers 11, 12, 13, and 14 may be planarized using a well-known etching method or the like, so that the first to fourth magnetic layers 11, 12, 13, and 14 may be coplanar with the first to fourth conductive layers 21, 22, 23, and 24. Thereafter, the respective first metal layers 202 and second metal layers 203 may be separated from each other to allow the first to fourth conductive layers 21, 22, 23, and 24 on which the first to fourth magnetic layers 11, 12, 13, and 14 are formed to be separated from the respective support members 201.

The processes described above with respect to FIGS. 7-9 are not limited to the disclosed sequences. For example, the first to fourth dry films 210, 220, 230, and 240 may be stripped away from the respective second metal layers 203 and first to fourth conductive layers 21, 22, 23, and 24 after the separating of the respective first metal layers 202 and second metal layers 203, and the first to fourth magnetic layers 11, 12, 13, and 14 may then be formed.

Figure 10:
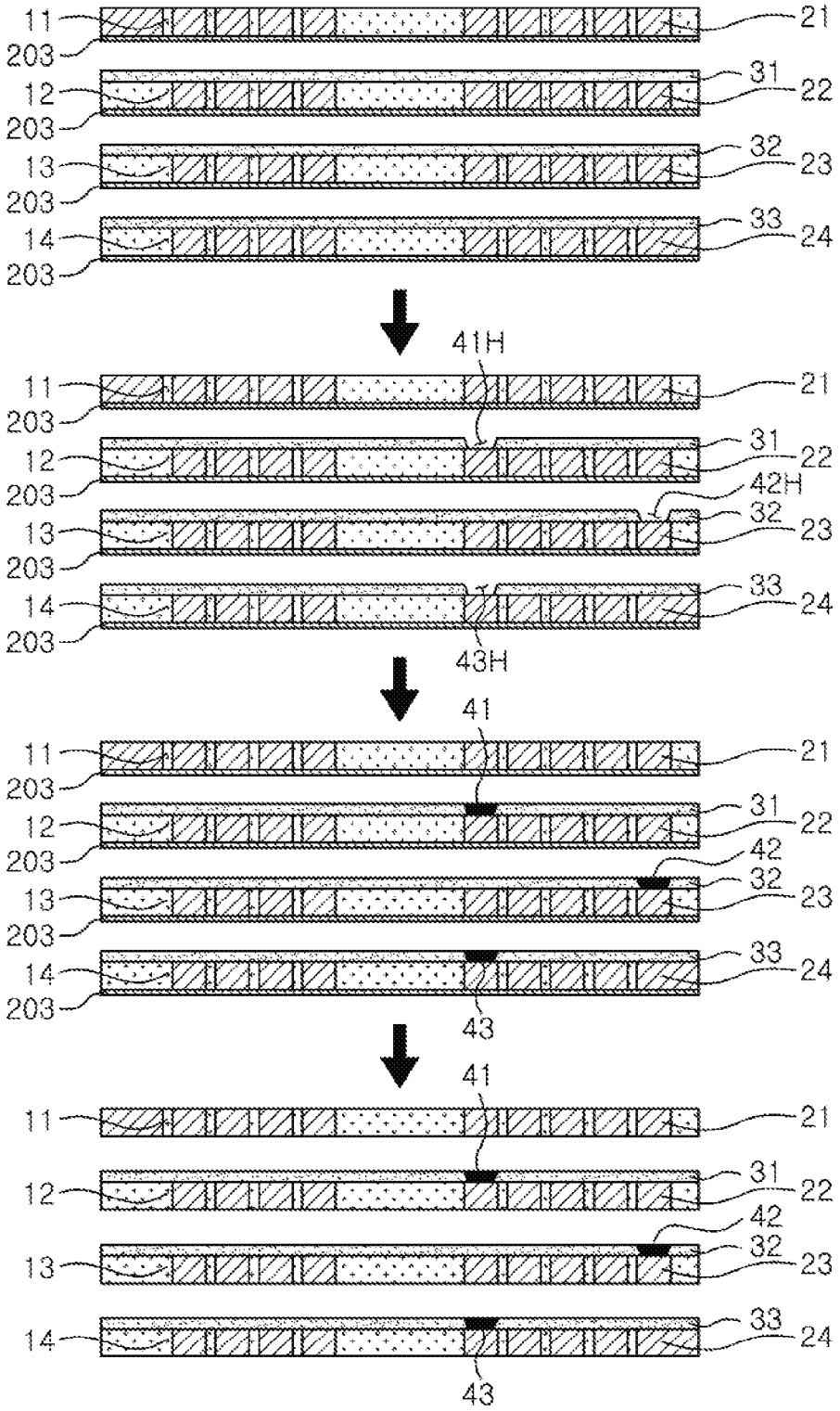

Referring to FIG. 10, the first to third insulating layers 31, 32, and 33 may be formed on the second to fourth conductive layers 22, 23, and 24, respectively. The first to third insulating layers 31, 32, and 33 may also be formed using a well-known layering or coating method. Subsequently, first to third via holes 41H, 42H, and 43H may be formed in the first to third insulating layers 31, 32, and 33, respectively. For example, the first to third via holes 41H, 42H, and 43H may be formed using laser machining or mechanical drilling, or a photolithography method. Subsequently, the first to third via holes 41H, 42H, and 43H may be filled with an inter-metallic compound (IMC) using, for example, a well-known paste printing method or soldering method to form the first to third vias 41, 42, and 43. Subsequently, the second metal layers 203 remaining on the first to fourth conductive layers 21, 22, 23, and 24 may be removed using a well-known etching method. The processes described with respect to FIG. 10 are not limited to the disclosed sequences. For example, the second metal layers 203 may alternatively be etched in advance. In some cases, the second metal layers 203 may be etched immediately after the separating of the second metal layers 203 from the respective first metal layers 202.

Figure 11:
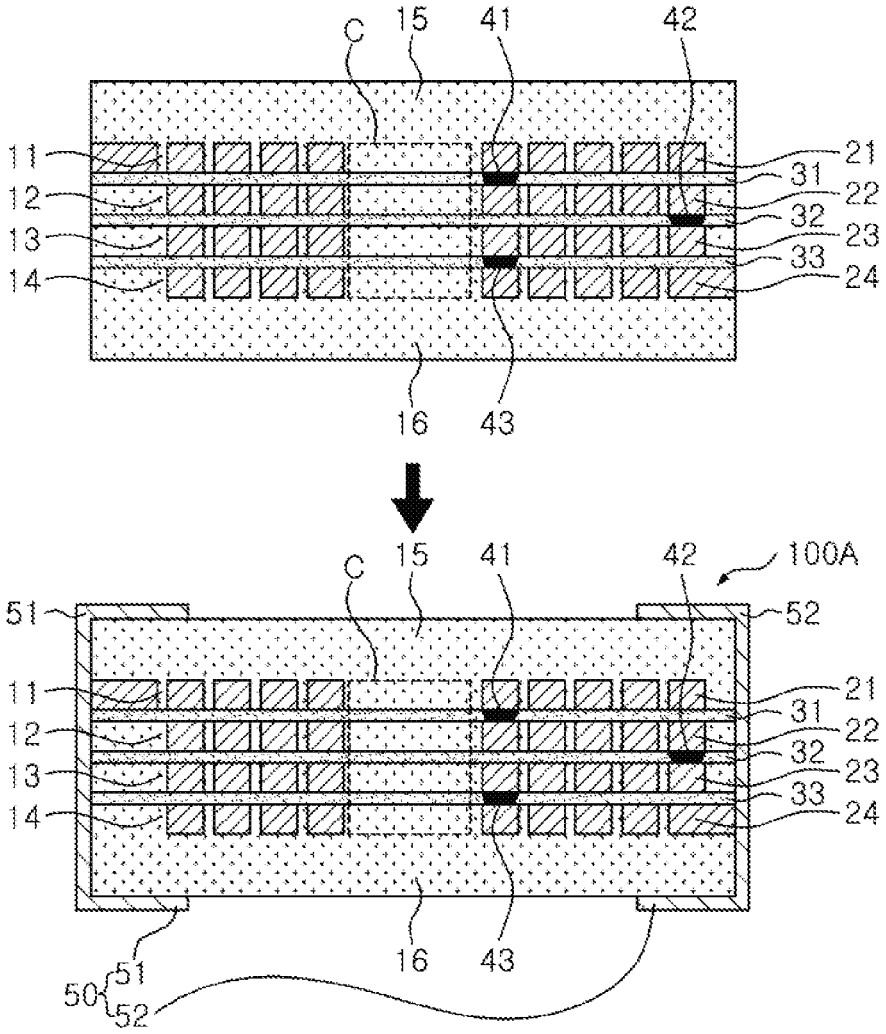

Referring to FIG. 11, the body 10 may be formed by collectively layering the first to fourth conductive layers 21, 22, 23, and 24, on which the first to fourth magnetic layers 11, 12, 13, and 14 and the first to third insulating layers 31, 32, and 33 are formed, in a stack, and layering the fifth and sixth magnetic layers 15 and 16, on upper and lower portions of the stack. More specifically, the first to fourth conductive layers 21, 22, 23, and 24, having first to fourth magnetic layers 11, 12, 13, and 14 and the first to third insulating layers 31, 32, and 33 formed thereon, may be stacked such that the third conductive layer 23 is disposed on top of the fourth conductive layer 24, the second conductive layer 22 is disposed on top of the third conductive layer 23, and the first conductive layer 21 is disposed on top of the second conductive layer 22. The fifth magnetic layer 15 may be layered on top of the first conductive layer 21, and the sixth magnetic layer 16 may be layered below the fourth conductive layer 24. The first to fourth conductive layers 21, 22, 23, and 24 surround the core portion C of the body 10. The first to third insulating layers 31, 32, and 33, and the first to fourth magnetic layers 11, 12, 13, and 14 extend through the core portion C.

The collective layering of the first to fourth conductive layers 21, 22, 23, and 24 may use a matching layering method, and under a high temperature condition of the matching layering method, an inter-metallic compound (IMC) may be finally formed to increase interlayer connectivity and reduce conductive resistance, thus enabling a smooth flow of electrons. In addition, the matching layering method may enable a precise interlayer connection, and a plurality of layers may be layered at a time to be beneficial to creating a streamlined process, as compared to a sequential layering method. The body 10 may be formed, and the first electrode 51 and the second electrode 52 may be formed. For example, the first electrode 51 and the second electrode 52 are formed using a paste layer including a metal having excellent conductivity, and a conductive layer may be further formed on the paste layer.

Figure 12:
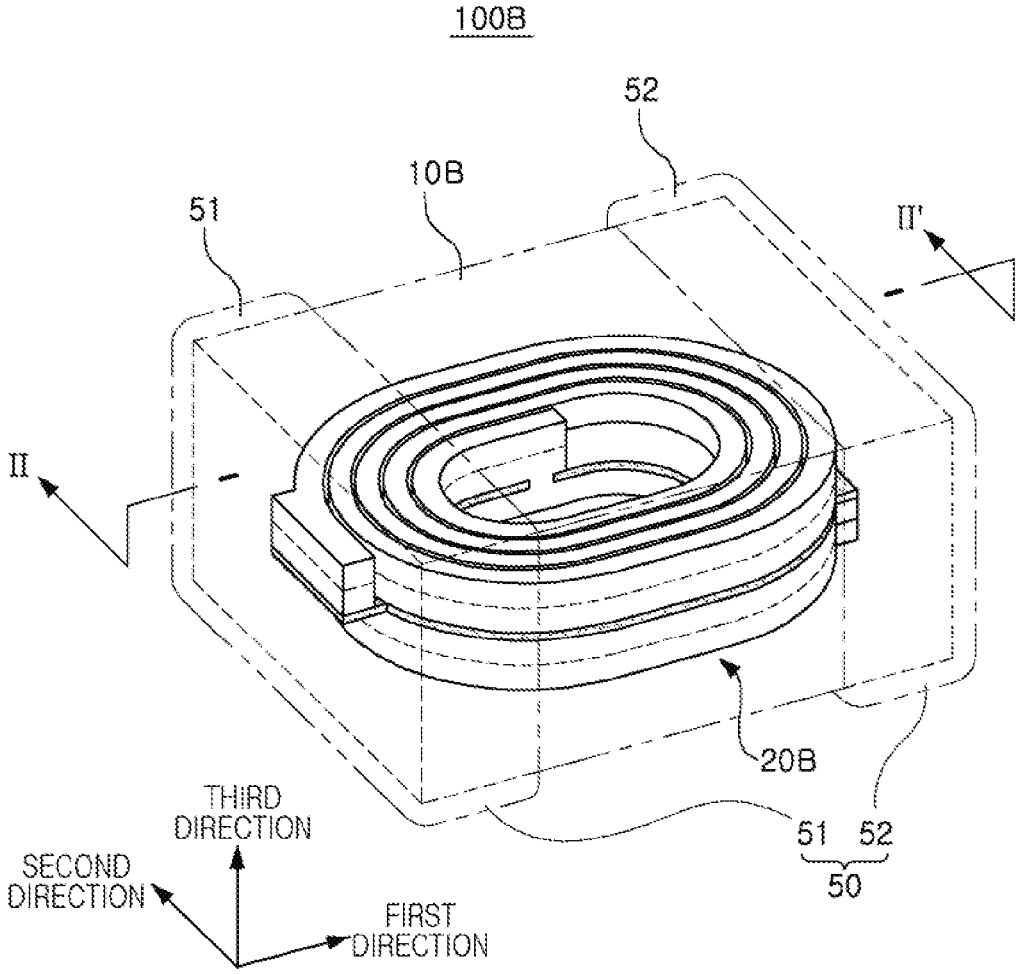
FIG. 12 is a schematic perspective view illustrating another example of a coil component.

FIG. 12 is a schematic perspective view illustrating an example of a coil component 100B. Referring to FIG. 12, the coil component 100B includes a body 10B and the electrode 50 disposed on the body 10B. A coil 20B may be disposed inside the body 10B. The coil 20B disposed inside the body 10B may be embedded in a magnetic material. The electrode 50 may include a first electrode 51 and a second electrode 52 spaced apart from each other on the body 10B. The first electrode 51 and the second electrode 52 may be connected to different terminals of the coil 20B, respectively. The descriptions regarding the appearances of the body 10B and the electrode 50 are the same as the descriptions of the appearances of the body 10 and the electrode 50 above, and will thus be omitted.

Figure 13:
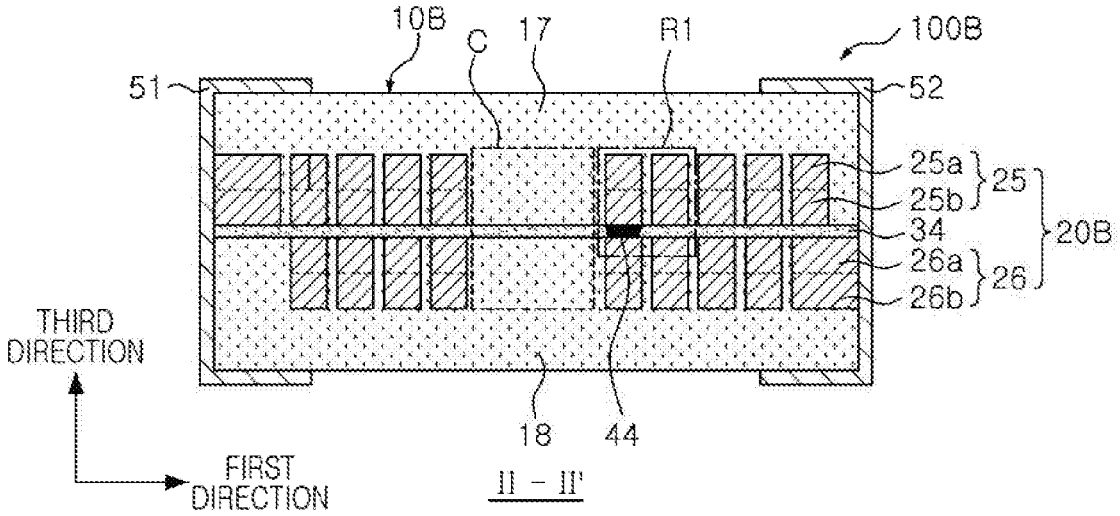
FIG. 13 is a schematic cutaway cross-sectional view taken along line II-II' of the coil component illustrated in FIG. 12.
Figure 14:
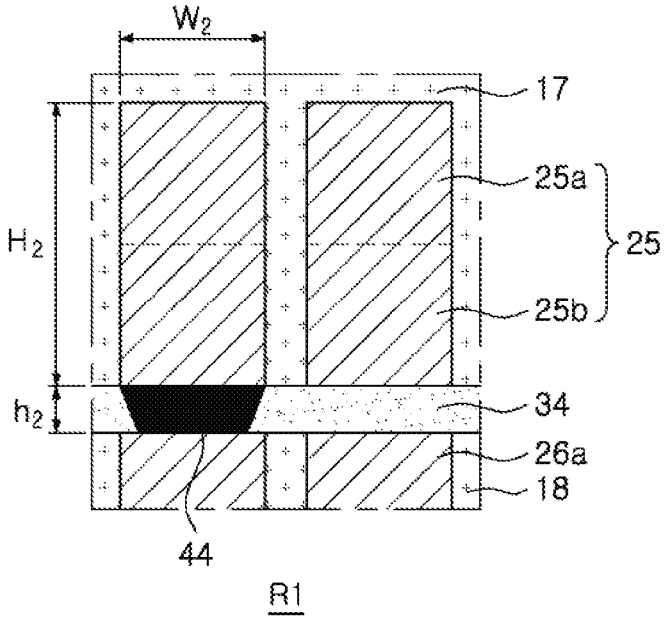
FIG. 14 is a schematic enlarged cross-sectional view of region R1 of the coil component illustrated in FIG. 13.

FIG. 13 is a schematic cutaway cross-sectional view of the coil component 100B taken along line II-II' of FIG. 12. FIG. 14 is a schematic enlarged cross-sectional view of region R1 of the coil component 100B illustrated in FIG. 13. Referring to FIGS. 13 and 14, the body 10B includes a fifth conductive layer 25 and a sixth conductive layer 26, a fourth insulating layer 34 disposed between the fifth and sixth conductive layers 25 and 26 and having a fourth via 44 formed therein to connect the fifth and sixth conductive layers 25 and 26 to each other, and a seventh magnetic layer 17 and an eighth magnetic layer 18 surrounding the fifth conductive layer 25 and the sixth conductive layer 26, respectively. The fifth and sixth conductive layers 25 and 26 may be connected to each other to form the single coil 20B having an increased number of turns in a horizontal direction and a vertical direction. Hereinafter, respective components will be described in more detail, but a description overlapping the abovementioned description will be omitted.

As shown in FIG. 13, the fifth and sixth conductive layers 25 and 26 surround a core portion C of the body 10B. The core portion C may be disposed at a central area of the body 10B. The fourth insulating layer 34, and the seventh and eighth magnetic layers 17 and 18 extend through the core portion C. However, in the example illustrated in FIG. 13, the fifth and sixth conductive layers 25 and 26 do not extend into the core portion C.

The fifth and sixth conductive layers 25 and 26 may each have planar spiral-shaped patterns. For example, the planar spiral-shaped pattern of each of the fifth and sixth conductive layers 25 and 26 may have a number of turns that is greater than or equal to two. For example, the coil 20 may an increased number of turns in the horizontal direction and the vertical direction, being beneficial to achieving a high degree of inductance. The planar spiral-shaped pattern of each of the fifth and sixth conductive layers 25 and 26 may have an aspect ratio (AR) of 1 or more, for example, 2 to 4, the AR being a ratio of a thickness $H_2$ to a width $W_2$. Thus, the disclosure may provide a microwidth of the coil component 100B, and may increase a cross section thereof, thus achieving low DC resistance ($R_{dc}$). Each of the fifth and sixth conductive layers 25 and 26 may include a plurality of plating layers. In detail, the fifth conductive layer 25 may include a first plating layer 25*a* and a second plating layer 25*b*. The sixth conductive layer 26 may include a first plating layer 26*a* and a second plating layer 26*b*. Thus, a high aspect ratio (AR) may be achieved without application of an anisotropic plating technology. Depending on a formation method of the first and second plating layers 25*a* and 25*b*, the first and second plating layers 25*a* and 25*b* may have a clear boundary therebetween, or in some cases, may have an unclear boundary therebetween. In addition, depending on a formation method of the first and second plating layers 26*a* and 26*b*, the first and second plating layers 26*a* and 26*b* may have a clear boundary therebetween, or in some cases, may have an unclear boundary therebetween. In some cases, the first and second plating layers 25*a* and 25*b* and the first and second plating layers 26*a* and 26*b* may include a larger number of plating layers, respectively. Each of the fifth and sixth conductive layers 25 and 26 may have no separate seed layer. For example, as can be seen from the following process descriptions, a metal layer functioning as a seed layer may be removed after forming of the fifth and sixth conductive layers 25 and 26. Thus, an upper or lower surface of each of the fifth and sixth conductive layers 25 and 26 may contact the fourth insulating layer 34. A material of each of the fifth and sixth conductive layers 25 and 26 may include a conductive material.

The fourth insulating layer 34 may selectively insulate the fifth and sixth conductive layers 25 and 26 from each other. Any material including an insulating material may be used as a material of the fourth insulating layer 34. For example, a well-known photoimageable dielectric (PID) resin or the like may be used. The fourth insulating layer 34 may also include an insulating resin and a magnetic filler. In this case, resistance of an interlayer magnetic field may be removed. A thickness $h_2$ of the fourth insulating layer 34 may be reduced, and for example, may be less than the thickness $H_2$ of the planar spiral-shaped pattern of each of the fifth and sixth conductive layers 25 and 26. This may allow a thickness of a magnetic material covering the coil 20B to be significantly increased, resulting in an increase in inductance. Further, a fourth via 44 having a microstructure is formed in the fourth insulating layer 34, so that the coil 20 through which an electric current flows may have a constant thickness.

As long as the fourth via 44 may electrically connect the fifth and sixth conductive layers 25 and 26 to each other, a shape of the fourth via 44 is not particularly limited. For example, the shape of the fourth via 44 may include any shape known in the technical field of this disclosure, including a tapered shape in which a diameter of the fourth via 44 decreases toward a lower surface of the fourth via 44, a reverse tapered shape in which the diameter increases toward the lower surface of the fourth via 44, or a circular shape. An inter-metallic compound (IMC) may be used as a material of the fourth via 44. In this case, connectivity between the fifth and sixth conductive layers 25 and 26 may be increased. For example, the inter-metallic compound (IMC) may be formed by printing a well-known metal paste in the fourth via 44, and may also be formed of a well-known metal coating.

The seventh and eighth magnetic layers 17 and 18 may improve magnetic properties of the coil 20B. Portions of the seventh and eighth magnetic layers 17 and 18 may be coplanar with the fifth and sixth conductive layers 25 and 26, respectively, and other portions of the seventh and eighth magnetic layers 17 and 18 may cover an upper portion of the fifth conductive layer 25 and a lower portion of the sixth conductive layer 26, respectively. The seventh and eighth magnetic layers 17 and 18 may be spaced apart from each other by the fourth insulating layer 34. The seventh and eighth magnetic layers 17 and 18 may surround the fifth and sixth conductive layers 25 and 26, respectively, and lateral surfaces of the fifth and sixth conductive layers 25 and 26 may contact the seventh and eighth magnetic layers 17 and 18, respectively. The coil component 100B may include the fourth insulating layer 34 having a reduced thickness as described above to thereby achieve a satisfactory thickness of each of the seventh and eighth magnetic layers 17 and 18, resulting in being beneficial to achieving a high degree of inductance. Any material including a magnetic material may be used as a material of each of the seventh and eighth magnetic layers 17 and 18. For example, the material may be a ferrite or a resin filled with metallic magnetic particles. Similar to the fourth insulating layer 34, the seventh and eighth magnetic layers 17 and 18 may include an insulating resin and a magnetic filler. For example, the seventh and eighth magnetic layers 17 and 18 and the fourth insulating layer 34 may be formed from the same material, based on performance and manufacturing objectives. When the seventh and eighth magnetic layers and the fourth insulating layer 34 are formed of the same material, boundaries between the fourth insulating layer 34 and seventh and eighth magnetic layers 17 and 18 may be unclear. In other words, the fourth insulating layer 34 and the seventh and eighth magnetic layers 17 and 18 may be integrated with each other. Such a configuration will be described below.

The drawings illustrate only the fifth and sixth conductive layers 25 and 26, the fourth insulating layer 34, the fourth via 44, and the seventh and eighth magnetic layers 17 and 18, but may include additional layers or fewer layers. The abovementioned description may apply to an additional layer in an identical manner, and a detailed description thereof will be omitted.

Figure 15:
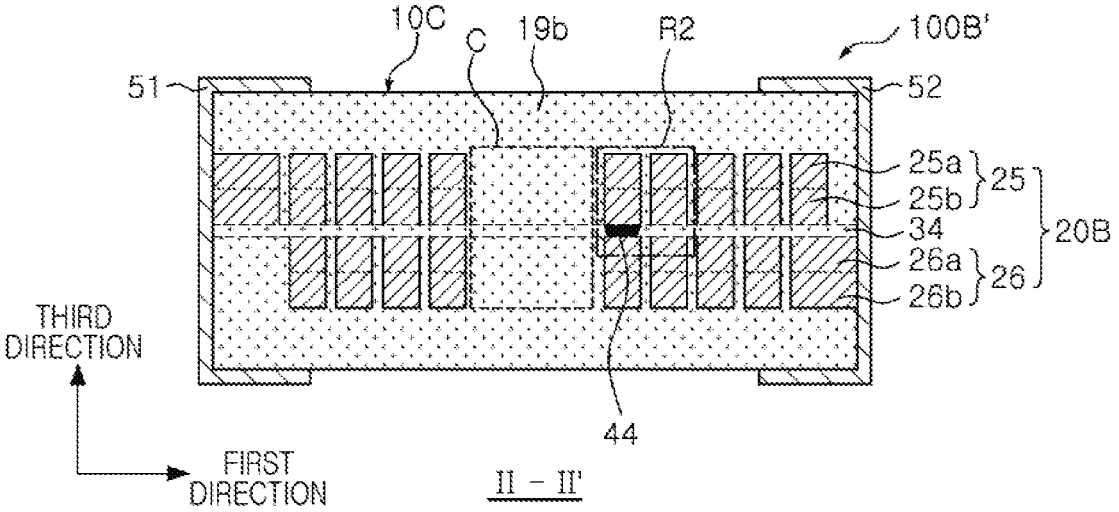
FIG. 15 is another schematic cutaway cross-sectional view taken along line II-II' of the coil component illustrated in FIG. 12.
Figure 16:
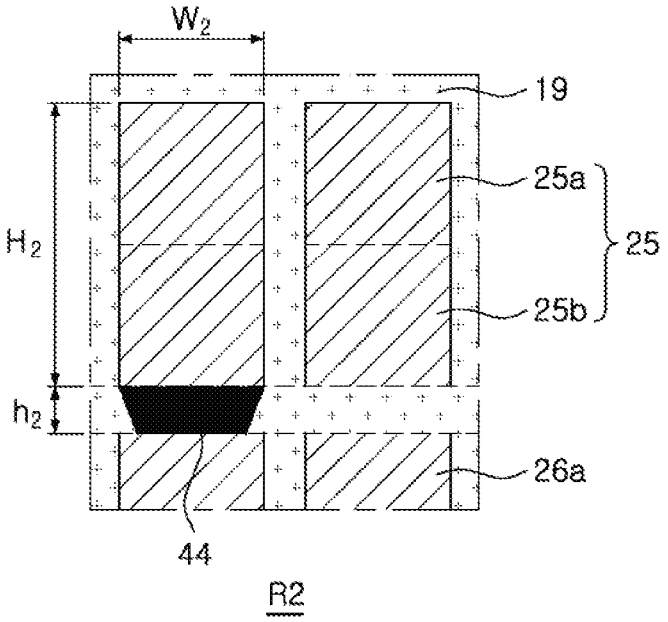
FIG. 16 is a schematic enlarged cross-sectional view of region R2 of the coil component illustrated in FIG. 15.

FIG. 15 is another schematic cutaway cross-sectional view taken along line II-II' of FIG. 12, illustrating a coil component 100B' according to another embodiment. FIG. 16 is a schematic enlarged cross-sectional view of region R2 of the coil component 100B' illustrated in FIG. 15. Referring to FIGS. 15 and 16, the body 100 of the coil component 100B' may include the fifth and sixth conductive layers 25 and 26 and a second electrically insulating magnetic layer 19*b* embedding the fifth and sixth conductive layers 25 and 26. The second electrically insulating magnetic layer 19*b* may have the fourth via 44 disposed in a space between the fifth and sixth conductive layers 25 and 26 to connect the fifth and sixth conductive layers 25 and 26 to each other. Similarly, the fifth and sixth conductive layers 25 and 26 may be connected to each other to form the single coil 20B having an increased number of turns in the horizontal direction and the vertical direction. A description overlapping the foregoing description may hereinafter be omitted, and the second electrically insulating magnetic layer 19*b* will be described in more detail below.

The second electrically insulating magnetic layer 19*b* may be formed by integrating the seventh and eighth magnetic layers 17 and 18 with each other. In other words, as described above, the fourth insulating layer 34 and the seventh and eighth magnetic layers 17 and 18 may include the same material, and for example, may include the same insulating resin and the same magnetic filler. In this case, the fourth insulating layer 34 and the seventh and eighth magnetic layers 17 and 18 may be integrated with each other in such a manner that boundaries therebetween may be unclear, depending on formation methods. That is, a single second electrically insulating magnetic layer 19*b* may be formed. The second electrically insulating magnetic layer 19*b* may selectively insulate the fifth and sixth conductive layers 25 and 26 from each other, and may improve magnetic properties.

FIGS. 17 through 21 are schematic views illustrating an example of a method of manufacturing a coil component, such as the coil component 100B illustrated in FIGS. 12-14, and/or the coil component 100B' illustrated in FIGS. 15-16. Referring to FIGS. 17 through 21, a method of manufacturing the coil component 100B includes: preparing a core board 200 including a support member 201 and first metal layers 202 and second metal layers 203 respectively disposed on opposing surfaces of the support member 201; forming a fifth conductive layer 25 and a sixth conductive layer 26, each having a planar spiral-shaped pattern, on the second metal layers 203 of the core board 200, respectively; forming a seventh magnetic layer 17 and an eighth magnetic layer 18 surrounding the fifth conductive layer 25 and the sixth conductive layer 26, respectively; separating the fifth conductive layer 25 and the sixth conductive layer 26, respectively surrounded by the seventh magnetic layer 17 and the eighth magnetic layer 18, from the support member 201; layering a fourth insulating layer 34 on the sixth conductive layer 26 of the fifth and sixth conductive layers 25 and 26; forming a fourth via 44 in the fourth insulating layer 34; removing the second metal layers 203 remaining on the fifth and sixth conductive layers 25 and 26; forming a body 10 by layering the fifth conductive layer 25 and the sixth conductive layer 26 having the fourth insulating layer 34 layered thereon and formed in a series of processes; and forming an electrode 50 on the body 10. A description overlapping the abovementioned description may hereinafter be omitted, and each of the processes will be described in more detail below.

Figure 17:
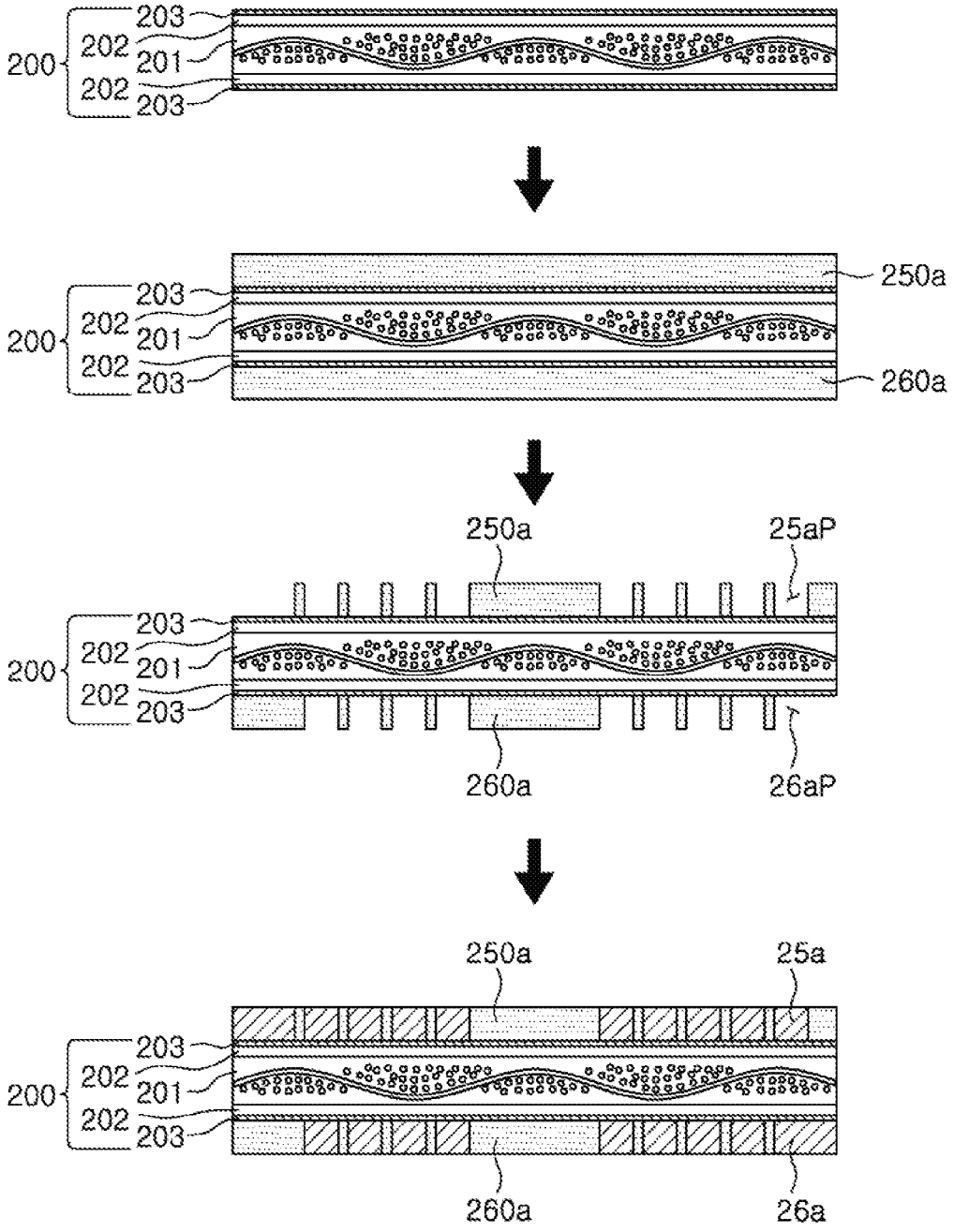
FIGS. 17-21 are schematic views illustrating another example of a method of manufacturing a coil component.

Referring to FIG. 17, the core board 200 may be prepared. The core board 200 may include the support member 201, the first metal layers 202 disposed on the opposing surfaces of the support member 201, and the second metal layers 203 respectively disposed on the first metal layers 202. In an embodiment, the first metal layer 202 and the second metal layer 203 may be disposed on only one surface of the support member 201. In another embodiment, only the second metal layer 203 may be disposed on one surface or opposing surfaces of the support member 201. For example, the support member 201 may be an insulating board including an insulating resin. The first metal layer 202 and the second metal layer 203 may each be a thin copper foil, but are not limited to such a construction, and may be different metal layers. Subsequently, a first plating layer 25*a* and a first plating layer 26*a* may be formed on the second metal layers 203 of the core board 200, respectively. The first plating layer 25*a* and the first plating layer 26*a* may be formed by forming a first dry film 250*a* and a second dry film 260*a* on the second metal layers 203, respectively, creating planar spiral-shaped channels or patterns 25*a*P and 26*a*P in the first and second dry films 250*a* and 260*a*, respectively, using a well-known photolithography method, and filling the planar spiral-shaped patterns 25*a*P and 26*a*P using a well-known plating method.

Figure 18:
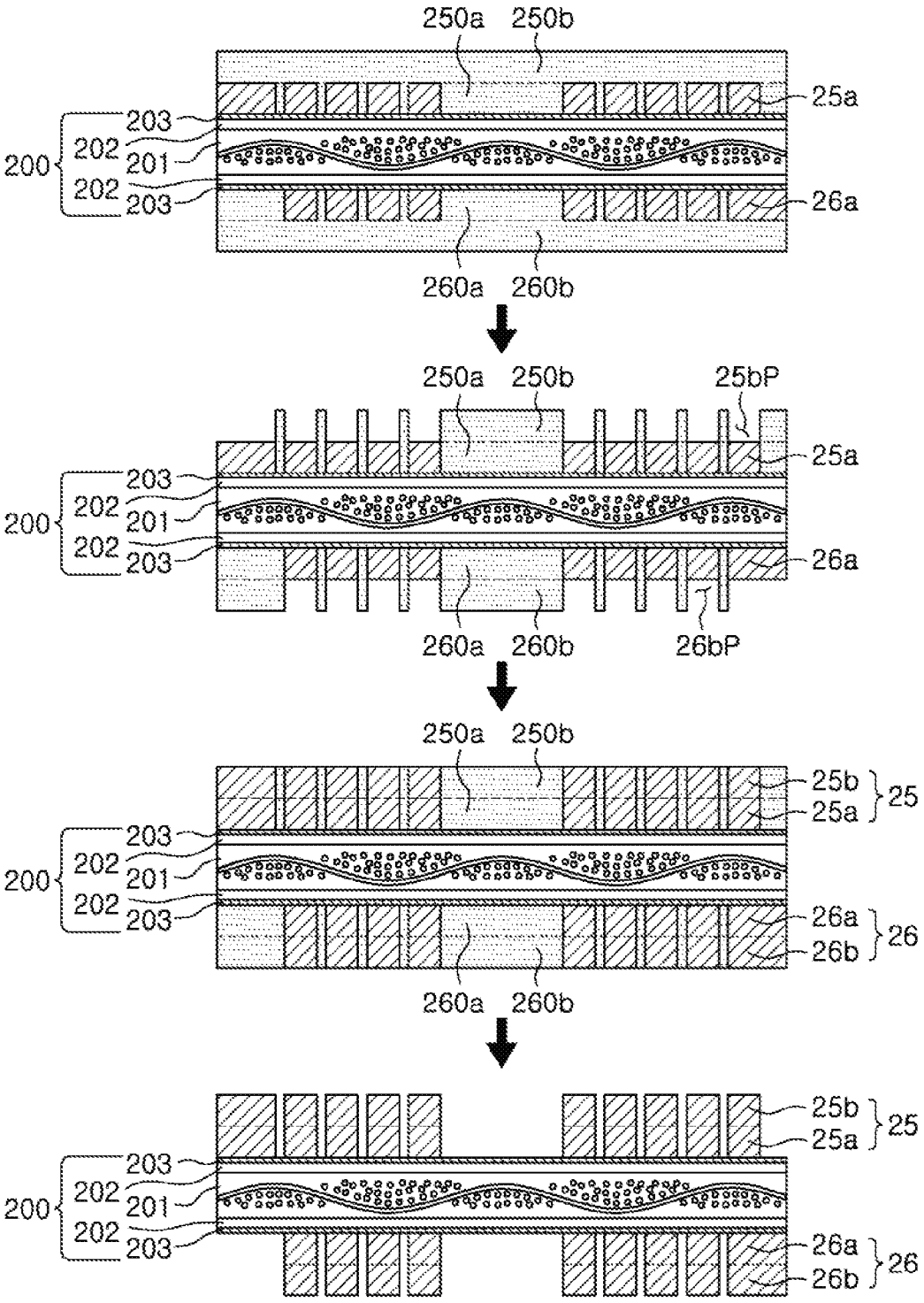

Referring to FIG. 18, a second plating layer 25*b* and a second plating layer 26*b* may be formed on the first plating layer 25*a* and the first plating layer 26*a*, respectively, to form a fifth conductive layer 25 and a sixth conductive layer 26, respectively. The second plating layers 25*b* and 26*b* may be formed by forming second dry films 250*b* and 260*b* on the second plating layers 25*b* and 26*b*, respectively, creating planar spiral-shaped patterns 25*b*P and 26*b*P of the second dry films 250*b* and 260*b*, respectively, using the well-known photolithography method, and filling the planar spiral-shaped patterns 25*b*P and 26*b*P using the well-known plating method. The first dry films 250*a* and 260*a* and the second dry films 250*b* and 260*b* may be thereafter stripped. A well-known etching method may be applied to perform the stripping, but the stripping is not limited to such a method.

Figure 19:
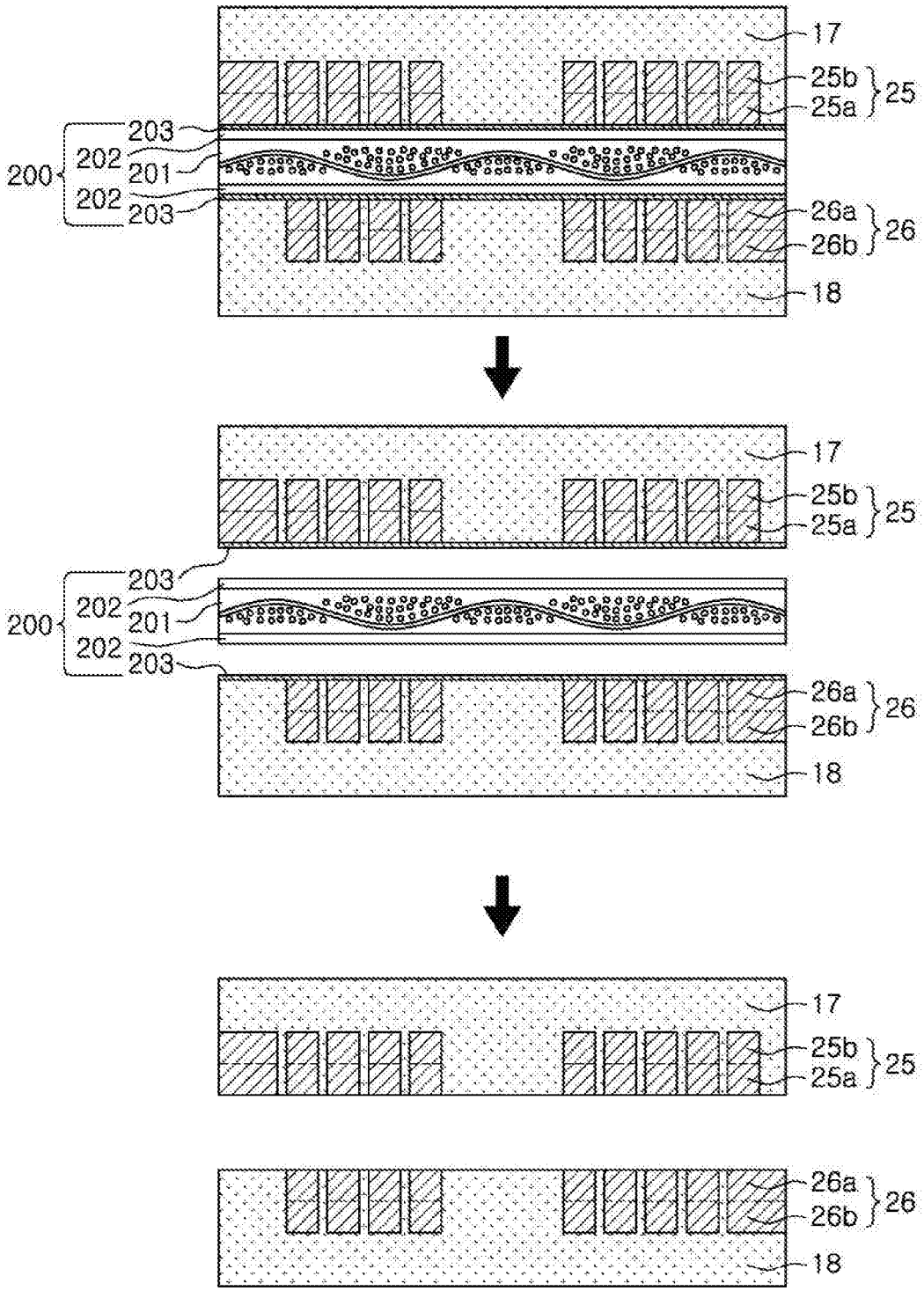

Referring to FIG. 19, the seventh and eighth magnetic layers 17 and 18 may be formed to surround the fifth and sixth conductive layers 25 and 26, respectively. The seventh and eighth magnetic layers 17 and 18 may be formed, for example, using a well-known layering or coating method. Thereafter, separating the first metal layers 202 and the respective second metal layers 203 from each other may allow the fifth and sixth conductive layers 25 and 26 on which the seventh and eighth magnetic layers 17 and 18 are formed to be separated from the support members 201, respectively. Subsequently, the second metal layers 203 remaining on the fifth and sixth conductive layers 25 and 26, respectively, may be removed using a well-known etching method. The processes described above with respect to FIGS. 17-19 are not limited to the disclosed sequences. For example, the first dry films 250*a* and 260*a* and the second dry films 250*b* and 260*b* may be stripped after the separating of the respective first metal layers 202 and second metal layers 202, and the seventh and eighth magnetic layers 17 and 18 may then be formed. In some cases, the fourth insulating layer 34 and the fourth via 44, which will be described below, may be formed, and the second metal layers 203 may then be etched.

Figure 20:
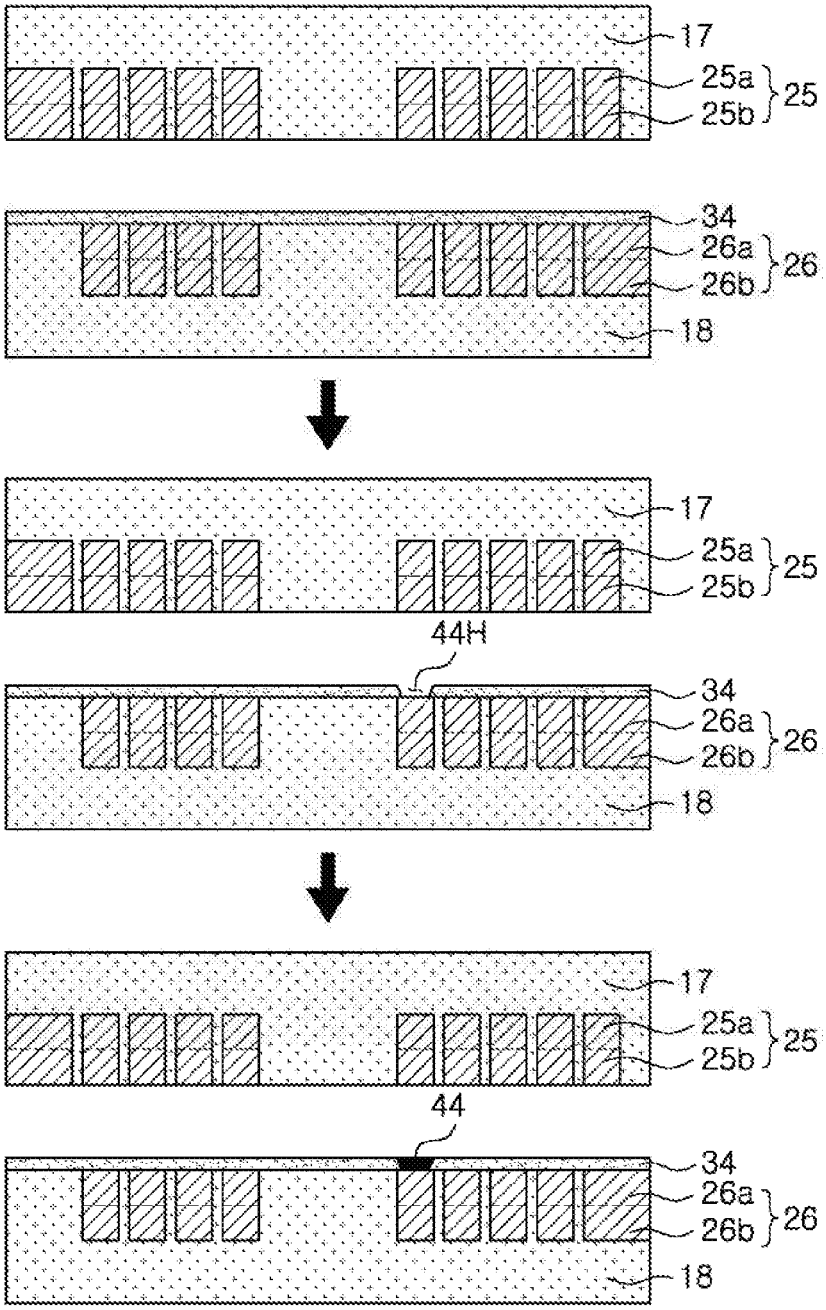

Referring to FIG. 20, the fourth insulating layer 34 may be formed on the sixth conductive layer 26. For example, the fourth insulating layer 34 may also be formed using a well-known layering or coating method. Subsequently, a fourth via hole 44H may be formed in the fourth insulating layer 34. The fourth via hole 44H may be formed, for example, using laser machining or mechanical drilling, or a photolithography method. Subsequently, the fourth via hole 44H may be filled with an inter-metallic compound (IMC) using a well-known paste printing method or soldering method to form the fourth via 44. The processes described above with respect to FIG. 20 are not limited to the disclosed sequences. For example, the second metal layers 203 may also be etched after the formation of the fourth insulating layer 34 and the fourth via 44.

Figure 21:
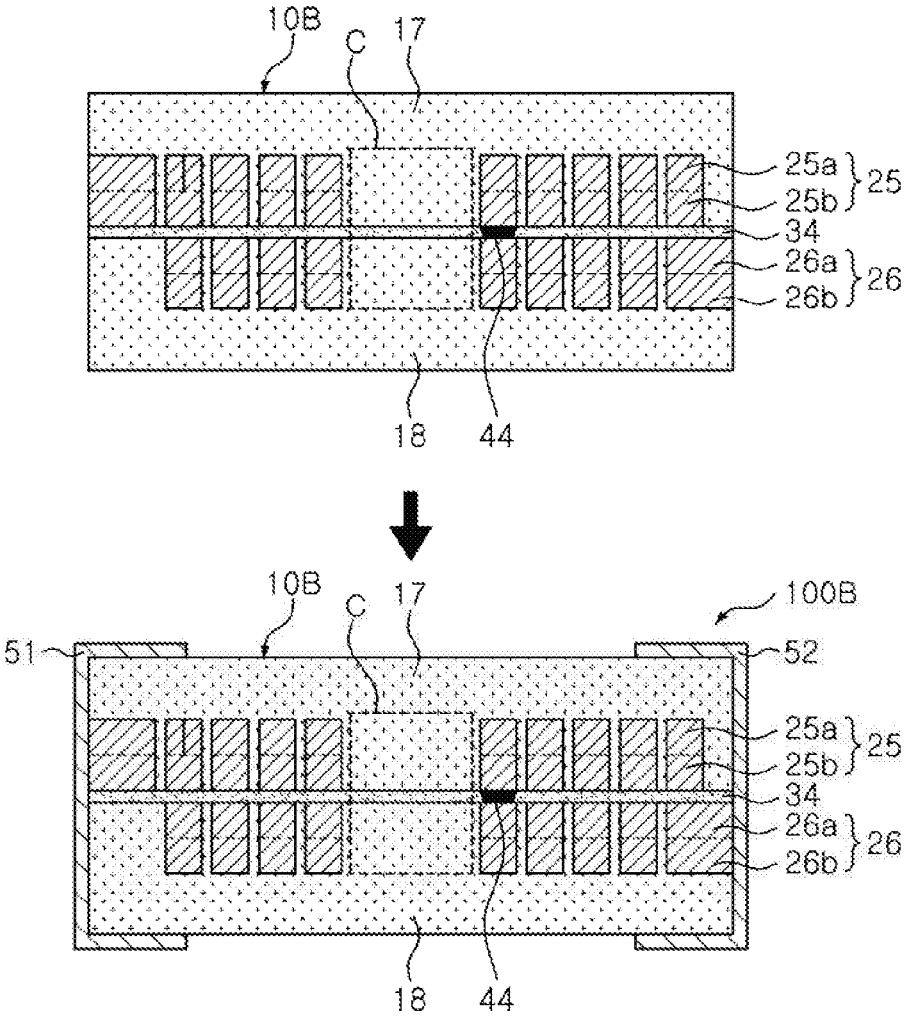

Referring to FIG. 21, the body 10B may be formed by collectively layering the seventh and eighth magnetic layers 17 and 18 and the fifth and sixth conductive layers 25 and 26 having the fourth insulating layer 34 formed therebetween in a stack. More specifically, for example, the fifth conductive layer 25 may be disposed on top of the sixth conductive layer 26, with the fourth insulating layer 34 disposed between the fifth and sixth conductive layers 25 and 26. The seventh magnetic layer 17 may be layered on top of the fifth conductive layer 25, and the eighth magnetic layer 18 may be layered below the sixth conductive layer 26. The collective layering of the seventh and eighth magnetic layers 17 and 18 and the fifth and sixth conductive layers 25 and 26 may use a matching layering method, and under a high temperature condition of the matching layering method, an inter-metallic compound (IMC) may be finally formed to increase interlayer connectivity and reduce conductive resistance, thereby enabling a smooth flow of electrons. In addition, the matching layering method may enable a precise interlayer connection, and a plurality of layers may be layered at a time to be beneficial to creating a streamlined process, as compared to a sequential layering method. The body 10B may be formed, and a first electrode 51 and a second electrode 52 may then be formed. The first electrode 51 and the second electrode 52 may be formed, for example, using a paste layer including a metal having excellent conductivity, and a conductive layer may be further formed on the paste layer.

Figure 22:
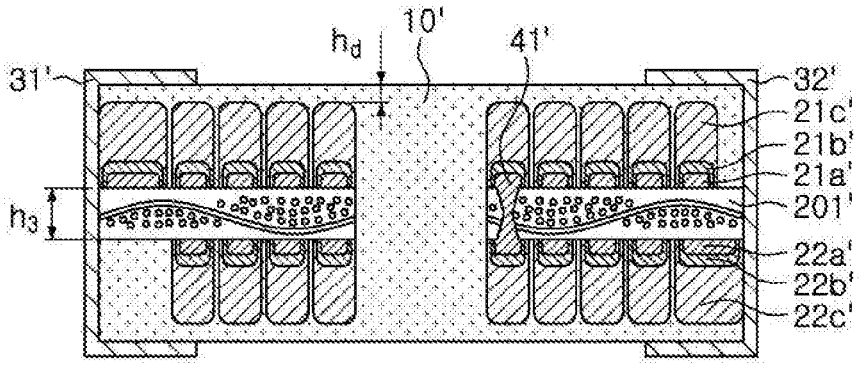
FIG. 22 is a schematic view illustrating an example of a coil component to which an anisotropic plating technology is adopted.

FIG. 22 is a schematic view illustrating an example of a coil component 100C to which an anisotropic plating technology is adopted. The coil component 100C may be manufactured by, for example, forming patterns 21*a*', 21*b*', 21*c*', 22*a*', 22*b*', and 22*c*' each having a planar coil shape on opposing surfaces of a support member 201', respectively, using the anisotropic plating technology and a via 41', embedding the patterns 21*a*', 21*b*', 21*c*', 22*a*', 22*b*', and 22*c*' and the via 41' in a magnetic material to form a body 10', and forming external electrodes 31' and 32' electrically connected to the patterns 21*a*', 21*b*', 21*c*', 22*a*', 22*b*', and 22*c*' outside of the body 10'. When the anisotropic plating technology is adopted, a high aspect ratio (AR) may be achieved. However, uniformity of plating growth may decrease as the AR increases. A coating having a thickness may have a wide distribution, and a short circuit between patterns may thus easily occur. In addition, a thickness $h_3$ of the support member 201' is relatively large, and a thickness $h_d$ of a magnetic material disposed on upper and lower portions of the patterns 21*a*', 21*b*', 21*c*', 22*a*', 22*b*', and 22*c*' may thus be limited.

As described herein, electrically connecting may include a physical connection and a physical disconnection.

As set forth above, according example embodiments herein, a novel structure of a coil component that may provide a sufficient thickness of a magnetic material covering a coil, and may allow for a high degree of inductance, and a method of manufacturing the same may be provided.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A coil component, comprising:

a body comprising a magnetic material, coil pattern layers encased by the magnetic material, wherein each of the coil pattern layers comprises a spiral-shaped pattern, and each of the coil pattern layers comprises a plating layer without a seed layer, magnetic layers comprised of the magnetic material, each of the magnetic layers being coplanar with one of the coil pattern layers with respect to a thickness direction of the body and surrounding the respective coil pattern layer such that lateral surfaces of the respective coil pattern layer contact the respective magnetic layer, a core portion surrounded by the coil pattern layers, a plurality of insulating layers disposed in the core portion, each of the insulating layers extending along a direction normal to the thickness direction of the body and being disposed only between adjacent coil pattern layers among the coil pattern layers such that upper and lower surfaces of the magnetic layers and the coil pattern layers that are disposed between adjacent insulating layers are in direct contact with the adjacent insulating layers and such that there is no insulating layer disposed below a lowermost coil pattern layer, each of the insulating layers comprising an insulating material, and at least one via disposed in each of the insulating layers, each of the vias connecting the adjacent coil pattern layers and having a tapered shape along the thickness direction of the body, each of the vias comprising an inter-metallic compound; and an external electrode disposed on the body, wherein the magnetic material is disposed above and below the coil pattern layers in the thickness direction of the body.

2. The coil component of claim 1, wherein the via is configured to pass through one or more of the insulating layers.

3. The coil component of claim 2, wherein a diameter of the via is decreased toward a lower surface of the via.

4. The coil component of claim 1, wherein the via comprises an intermetallic compound (IMC).

5. The coil component of claim 1, wherein the coil pattern layers and the insulating layers are alternately stacked.

6. The coil component of claim 1, wherein each of the coil pattern layers comprises a planar spiral-shaped pattern, and wherein the planar spiral-shaped pattern has a thickness-to-width ratio of 0.5 to 1.5.

7. The coil component of claim 1, wherein a thickness of each of the insulating layers is less than a thickness of each of the coil pattern layers.

8. The coil component of claim 1, wherein each of the insulating layers comprises a photoimageable dielectric (PID) resin.

* * * * *